US006138620A

United States Patent [19]

Nemoto et al.

[11] Patent Number: 6,138,620

[45] Date of Patent: Oct. 31, 2000

[54] VALVE OPERATING SYSTEM IN AN INTERNAL COMBUSTION ENGINE

[75] Inventors: Hirotomi Nemoto; Tetsuya Ishiguro; Takeshi Gomi; Yuichi Shimasaki; Shigekazu Tanaka; Hidetoshi Ohishi, all of Wako, Japan

[73] Assignee: Honda Giken Kogyo Kabushiki Kaisha, Tokyo, Japan

[21] Appl. No.: 09/179,878

[22] Filed: Oct. 28, 1998

[30] Foreign Application Priority Data

| | | | |
|---|---|---|---|
| Oct. 29, 1997 | [JP] | Japan | 9-297129 |
| Mar. 18, 1998 | [JP] | Japan | 10-068203 |
| Mar. 19, 1998 | [JP] | Japan | 10-069966 |

[51] Int. Cl.[7] ..... F01L 9/04

[52] U.S. Cl. ..... 123/90.11; 123/90.15

[58] Field of Search ..... 123/90.11, 90.15

[56] References Cited

FOREIGN PATENT DOCUMENTS 0 826 866 A2 3/1998 European Pat. Off. .

196 23 257 A1 6/1997 Germany .

3-92520 4/1991 Japan .

OTHER PUBLICATIONS

Patents Abstracts of Japan, vol. 009, No. 333 (M–443), Dec. 27, 1985.

Patents Abstracts of Japan, vol. 009, No. 128 (M–384), Jun. 4, 1985 & JP 60 011612 A, Jan. 21, 1985.

*Primary Examiner*—Noah P. Kamen

*Attorney, Agent, or Firm*—Arent Fox Kintner Plotkin & Kahn, PLLC

[57] ABSTRACT

An actuator is connected to one of components forming a power transmitting device capable of transmitting a power provided by a valve operating cam provided on a cam shaft, so that the actuator can drive an engine valve in a lift amount which is obtained by addition of a lift amount of the engine valve based on a cam profile of the valve operating cam and a lift amount of the engine valve based on the operation of the actuator. Thus, a portion of the lift amount of the engine valve is borne by the valve operating cam, whereby a valve-opening power borne by the actuator can be reduced, as compared with a system designed so that the engine valve is driven by only the actuator only. The amount of electric power consumed by the actuator can be smaller.

12 Claims, 20 Drawing Sheets

VALVE OPERATING SYSTEM IN AN INTERNAL COMBUSTION ENGINE

BACKGROUND OF THE INVENTION

1. Field of the Invention

The present invention relates to a valve operating system in an internal combustion engine, and particularly, to a valve operating system in an internal combustion engine including an electric actuator which enables a power to be applied in an valve-opening direction to an engine valve that is biased in a valve-closing direction by a spring.

2. Description of the Related Art

Such a valve operating system is conventionally already known, for example, from Japanese Patent Application Laid-open No. 3-92520 or the like.

In the above known system, however, the engine valve is opened and closed only by the electric actuator. For this reason, the operational characteristic of the engine valve can be changed depending on the operational state of the engine, but the actuator must exhibit a driving force corresponding to a maximum lift amount of the engine valve, resulting in an increased amount of electric power consumed in the actuator.

SUMMARY OF THE INVENTION

Accordingly, it is an object of the present invention to provide a valve operating system in an internal combustion engine, wherein the amount of electric power consumed in the actuator can be reduced.

To achieve the above object, according to a first aspect and feature of the present invention, there is provided a valve operating system in an internal combustion engine comprising an electric actuator which enables a power to be applied in a valve-opening direction to an engine valve that is biased in a valve-closing direction by a spring, wherein the actuator is connected to one of components of a power transmitting means capable of transmitting a power provided by a valve operating cam provided on a cam shaft to the engine valve, so that the engine valve can be driven in a lift amount obtained by addition of a lift amount of the engine valve based on a cam profile of the valve operating cam and a lift amount of the engine valve based on the operation of the actuator.

With such arrangement, a portion of the lift amount of the engine valve is borne by the valve operating cam. Therefore, the valve-opening power borne by the actuator can be small, as compared with a system in which the engine valve is driven by the actuator only, and hence, the amount of electric power consumed in the actuator can be also small.

According to a second aspect and feature of the present invention, in addition to the first feature, the components of power transmitting means are: an inner ring which is turnable about an axis parallel to the cam shaft; an outer ring which is turnable about the same axis as of the inner ring and surrounds the inner ring; and a carrier on which planetary rotors disposed between the inner and outer rings are carried for rotation about axes parallel to the axis of the inner and outer rings, the carrier being turned in operative association with a revolving movement of the planetary rotors around the inner ring, a first one of the components being connected to the engine valve, a second one of the components being operatively connected to the valve operating cam, and the actuator being connected to a third one of the components.

With the arrangement of the second feature, the power transmitting means is formed into a planetary gear type or a planetary friction type from the inner and outer rings and the carrier as the components. The three components are connected to the engine valve, the valve operating cam and the actuator, respectively. Therefore, when the independent powers from the valve operating cam side and the actuator side are simultaneously applied to the power transmitting means, they can be synergetically transmitted to the engine valve, while avoiding the creation of a collision point, thereby providing a reduction in size of the power transmitting means.

According to a third aspect and feature of the present invention, in addition to the first feature, the valve operating cam has a cam profile which provides a lift characteristic describing a buffer curve is described immediately before closing and seating of the engine valve, and the system further includes a control means for controlling the actuator, the control means being arranged to stop the delivery of a driving force from the actuator to the power transmitting means at least at a moment immediately before closing and seating of the engine valve within a period while the engine valve is open.

With the arrangement of such third feature, at least at a moment immediately before closing and seating of the engine valve, the engine valve is gently seated according to the cam profile of the valve operating cam. Thus, the bouncing of the engine valve can be prevented from occurring; it is unnecessary to finely control the operation of the actuator in order to provide the gentle operation of the engine valve, and the control of the operation of the actuator can be simplified.

According to a fourth aspect and feature of the present invention, in addition to the arrangement of the second feature, the inner ring is connected to the engine valve; one of the carrier and the outer ring is operatively connected to the valve operating cam on the cam shaft for turning movement in response to the rotation of the cam shaft, and the actuator is connected to the other of the carrier and the outer ring. With such arrangement, the amount of turning movement of the carrier or the inner ring operatively connected to the cam shaft is smaller than the amount of turning movement of the inner ring operatively connected to the engine valve. Therefore, the size of the valve operating cam can be set at a remarkably small value relative to the lift amount required for the engine valve, i.e., the amount of turning movement of the inner ring, whereby the load received from the valve operating cam by the carrier or the outer ring can be reduced remarkably to contribute to the alleviation of the valve operating load. Further, a space required for the rotation of the valve operation cam as well as a space required for the operation of the portion of the carrier operatively connected with the valve operating cam can be relatively reduced, because the size of the valve operating cam is relatively reduced, and hence, a valve operating chamber in which the valve operating system disposed can be made compact. The power transmitting means can be arranged compact, thereby providing a reduction in size of the valve operating system.

According to a fifth aspect and feature of the present invention, in addition to the arrangement of the fourth feature, the carrier is operatively connected to the valve operating cam, and the actuator is connected to the outer ring. With such arrangement, the amount of turning movement of the carrier operatively connected to the valve operating cam relative to the amount of turning movement of the inner ring connected to the engine valve is smaller than the amount of turning movement of the outer ring in a case where the outer ring is operatively connected to the valve operating cam. Therefore, the size of the valve operating cam can be set at a smallest value relative to the lift amount required for the engine valve, i.e., the amount of turning movement of the inner ring , as compared with a case where the outer or the inner ring of the power transmitting means is operatively connected to the valve operating cam, thereby minimizing the load received from the valve operating cam by the carrier to further alleviating the valve operating load. Moreover, because the valve operating cam is smallest in size, a space required for the rotation of the valve operating cam as well as a space required for the operation of the portion of the carrier operatively connected with the valve operating cam is relatively small and hence, the valve operating chamber in which the valve operating system disposed can be made further compact. Further, the amount of turning movement of the outer ring caused by the actuator is also relatively small and hence, the actuator can be of a relatively reduced size, leading to a simplified structure of connection between the outer ring and the actuator and also to an increased freedom degree in the disposition of the connected portions of the outer ring and the actuator.

According to a sixth aspect and feature of the present invention, in addition to the arrangement of the second feature, the power transmitting means is formed into a planetary gear type having a sun gear which is the inner ring, a ring gear which is the outer ring, and the carrier on which planetary gears as the planetary rotors are rotatably carried. With such arrangement, the operational characteristic of the engine valve can be accurately controlled by meshed connections of the components forming the power transmitting means with one another.

According to a seventh aspect and feature of the present invention, in addition to the arrangement of the second feature, a support shaft for supporting the inner ring for turning movement, the support shaft having an axis disposed in parallel to but offset from the axis of the cam shaft. With such arrangement, the cam shaft can be formed in a simple structure in which the valve operating cam is only provided thereon.

According to an eighth aspect and feature of the present invention, in addition to the arrangement of the fifth feature, the carrier is integrally provided with a roller retaining arm extending on the side of the valve operating cam, and a roller is pivoted at a tip end of the roller retaining arm to come into rolling contact with the valve operating cam. With such arrangement, by the formation of the roller retaining arm integral with the carrier, the rigidity of the carrier itself can be enhanced, and the stable operations of the inner and the outer rings and the planetary rotors are carried out, thereby enhancing the accuracy of the operational characteristic of the engine. In addition, the valve operating cam and the carrier are operatively connected to each other by the rolling contact of the roller pivoted at the tip end of the roller retaining arm with the valve operating cam and therefore, the resistance of friction between the valve operating cam and the carrier can be reduced.

According to a ninth aspect and feature of the present invention, in addition to the arrangement of the eighth feature, the carrier comprises a pair of support plates disposed on opposite side of the planetary rotors, and shafts which are provided to extend between the support plates and on which the planetary rotors are rotatably carried, the roller is formed larger than an entire axial length of the planetary rotor and is supported rotatably by a roller shaft, the roller shaft being fixed at opposite ends thereof to a pair of the roller retaining arms integrally provided on the support plates, with steps for supporting the outer ring being formed between inner surfaces of the roller retaining arms and inner surfaces of the support plates. With such arrangement, not withstanding that the roller retaining arms are integrally provided on the carrier, the structure of supporting the outer ring for rotation by an outer periphery of the carrier can be simplified. In addition, by setting the axial length of the roller at a relatively large value, the area of contact between the roller and the valve operating cam can be increased to a relatively large value, thereby further reducing the resistance of friction between the valve operating cam and the carrier.

According to a tenth aspect and feature of the present invention, in addition to the second feature, the second one of the components of the power transmitting means is operatively connected to a first valve operating cam provided on the cam shaft, and the valve operating system further includes a connection switch-over means which is provided between one of the first and second components and a rocker arm rotatable about the same axis as of the inner ring in a manner to follow a second valve operating cam provided on the cam shaft, the connection switch-over means being capable of being switched over between a connecting state in which the one of the first and second components is connected to the rocker arm, and a disconnecting state in which the connection between the one of the first and second components and the rocker arm is released, a control means for controlling the operations of the actuator and the connection switch-over means, the control means being arranged to change over a control mode thereof, depending on the operational state of the engine, between a first control mode in which the actuator is in an operative state and the connection switch-over means is brought into the disconnecting state, and a second control mode in which the actuator is brought into an inoperative state and the connection switch-over means is brought into the connecting state.

With such arrangement of the tenth feature, when the control means selects the first control mode, the first and second components of the three components forming the power transmitting means are operatively connected to the first valve operating cam and the engine valve, respectively, and the third component is rotated by the actuator, so that the turning movement of the second component attendant on the turning movement of the first component caused by the rotation of the cam shaft, i.e., the operational characteristic of the engine valve, is controlled thereby. Thus, the operational characteristic of the engine valve can be finely controlled by finely controlling the turning movement of the third component by the actuator, When the control means selects the second control mode, the turning movement of the third component by the actuator is canceled and hence, the valve operating force is not transmitted from the first valve operating cam through the power transmitting means. However, the rocker arm driven by the second valve operating cam is connected to either of the first and second components and hence, the engine valve can be opened and closed by the second valve operating cam. Therefore, in an operational range in which a problem arises due to the operation of the actuator, the engine valve is driven by the second valve operating cam by selecting the second control mode, thereby making it possible to avoid the problem due to the operation of the actuator.

According to an eleventh aspect and feature of the present invention, in addition to the tenth feature, the connection switch-over means is arranged so that the connecting state and the disconnecting state are switched over from one to the other in accordance with a hydraulic pressure, and the control means is formed to output a signal indicative of a command to bring the electric actuator into the inoperative state after completion of the connecting operation of the connection switch-over means, when the control mode is switched over from the first control mode to the second control mode, and to output a signal indicative of a command to bring the connection switch-over means into the disconnecting state after outputting of a signal indicative of a command to bring the actuator into the operative state, when the control mode is switched over from the second control mode to the first control mode.

With such arrangement of the eleventh feature, when the control mode is switched over from the first control mode to the second control mode, the actuator is brought into the inoperative state after completion of the connecting operation of the hydraulic connection switch-over means, whose connecting operation is liable to be late, as compared with the operation of the electric actuator. Therefore, it is possible to prevent the operation of the engine valve from being disturbed because the actuator is brought into the inoperative state before the driving of the engine valve by the second valve operating cam is started. When the control mode is switched over from the second control mode to the first control mode, the actuator is brought into the operative state, before the connection switch-over means is brought into the disconnecting state. Therefore, it is possible to prevent the operation of the engine valve from being disturbed because the connection switch-over means is brought into the disconnecting state, before the driving of the engine valve by the power transmitting means and the actuator is started.

According to a twelfth aspect and feature of the present invention, in addition to the eleventh feature, the control means is arranged to select the second control mode in a lower-speed operational range of the engine and to select the first control mode in a higher-speed operational range of the engine. With such the arrangement of the twelfth feature, it is possible to avoid the consumption of the electric power of a battery by the actuator in the lower-speed operational range of the engine in which the charged amount of the battery is relatively small, thereby preventing the operation of the actuator from exerting an adverse influence on the battery.

According to a thirteenth aspect and feature of the present invention, in addition to the tenth feature, the control means is arranged to select the first control mode in a lower-speed operational range of the engine and to select the second control mode in a higher-speed operational range of the engine. With such arrangement of the thirteenth feature, it is possible to ensure that the responsiveness required for the actuator corresponds to the lower-speed operational range of the engine. Therefore, it is unnecessary to increase the speed of the operation of the actuator and to reduce the size of the actuator, which can contribute to a reduction in consumption of electric power, when the actuator is of an electric type.

The above and other objects, features and advantages of the invention will become apparent from the following description of the preferred embodiments taken in conjunction with the accompanying drawings.

BRIEF DESCRIPTION OF THE DRAWINGS

FIGS. 1 to 9 show a first embodiment of the present invention, wherein

FIG. 1 is a vertical sectional view of an essential portion of an internal combustion engine;

FIG. 2 is an enlarged sectional view taken along a line 2—2 in FIG. 1;

FIG. 3 is an enlarged sectional view taken along a line 3—3 in FIG. 1;

FIG. 4 is a schematic sectional view showing an arrangement of an actuator;

FIG. 5 is a diagram of a valve-opening lift characteristic for an intake valve;

FIG. 6 is a sectional view showing a situation of an operation of the actuator at the start of the opening of the intake valve;

FIG. 7 is a sectional view showing a situation of the operation of the actuator, when the intake valve is maintained in an opened state;

FIG. 8 is a sectional view showing a situation of the operation of the actuator, when the intake valve is closed;

FIG. 9 is a sectional view showing a situation of the operation of the actuator, when the intake valve is maintained in a closed state;

FIGS. 11 to 19 show a third embodiment of the present invention, wherein FIG. 11 is a vertical sectional view of an essential portion of a multi-cylinder internal combustion engine;

FIG. 12 is a sectional view taken along a line 12—12 in FIG. 11;

FIG. 13 is an enlarged sectional view taken along a line 13—13 in FIG. 12;

FIG.14 is a sectional view taken along a line 14—14 in FIG. 12;

FIG. 15 is a sectional view taken along a line 15—15 in FIG. 12;

FIG. 16 is a plan view taken along a line 16—16 in FIG. 11, with a head cover being omitted;

FIG. 17 is a bock diagram showing an arrangement of a control system;

FIG. 18 is a flow chart showing a control procedure, when the control mode is switched over from a first control mode to a second control mode;

FIG. 19 is a flow chart showing a control procedure, when the control mode is switched over from the second control mode to the first control mode.

DETAILED DESCRIPTION OF THE PREFERRED EMBODIMENTS

Figure 1:
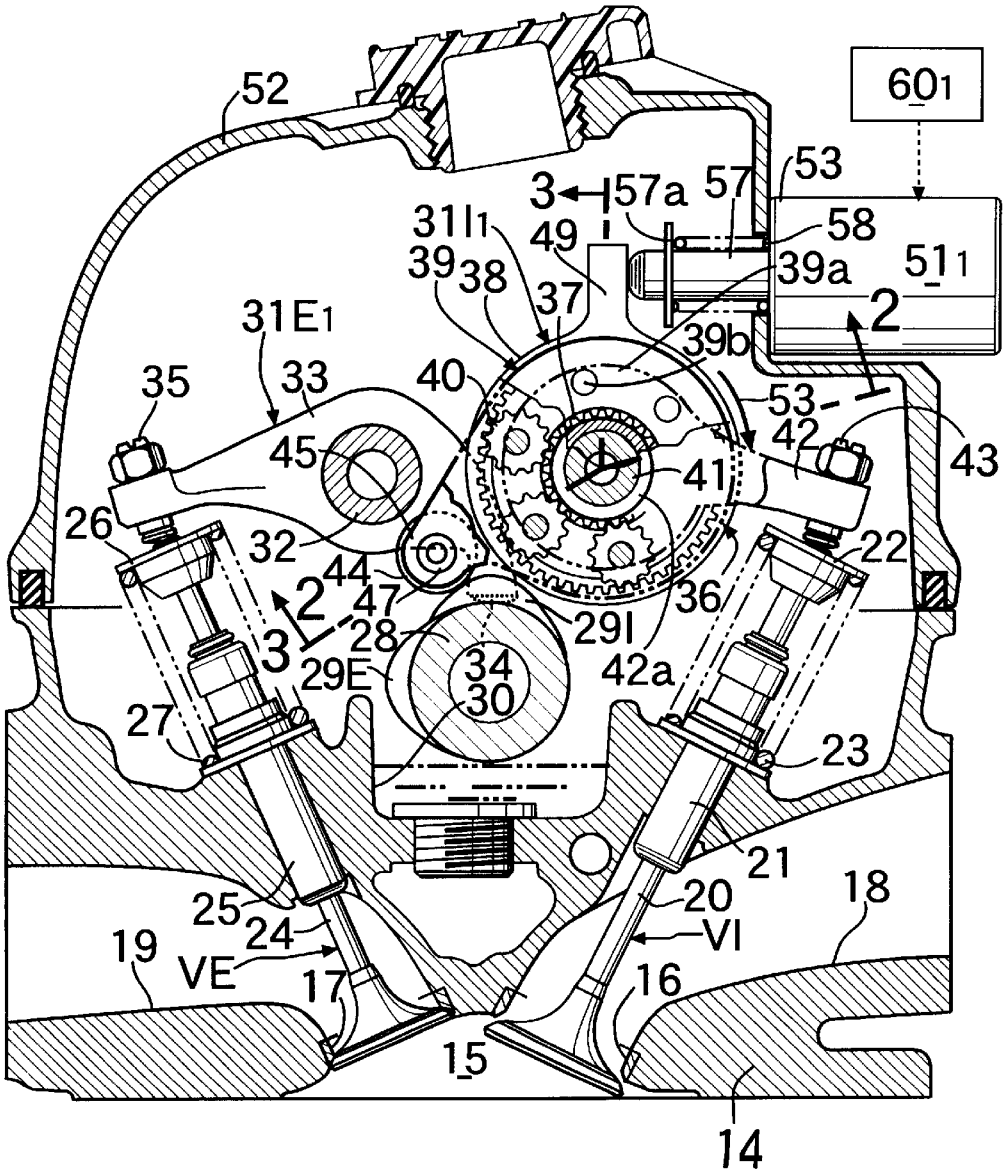

A first embodiment of the present invention will now be described with reference to FIGS. 1 to 9. Referring first to FIG. 1, a combustion chamber 15 is defined between an upper surface of a piston slidably received in a cylinder block (not shown) and a cylinder head 14. A pair of intake valve bores 16 and a pair of exhaust valve bores 17 are provided in the cylinder head 14, so that they open into a ceiling surface of the combustion chamber 15. The intake valve bores 16 communicate with an intake port 18, and the exhaust valve bores 17 communicate with an exhaust port 19.

Stems 20 of intake valves VI as a pair of engine valves capable of being opening and closing the intake valve bores 16 are slidably received in guide tubes 21 mounted in the cylinder head 14, respectively. Coiled valve springs 23 are mounted between the cylinder head 14 and retainers 22 mounted at upper ends of the stems 20 projecting upwards from the guide tubes 21, so as to surround the stems 20, so that the intake valves VI are biased by the valve springs 23 in a direction to close the intake valve bores 16. Stems 24 of a pair of exhaust valves VE capable of opening and closing the exhaust valve bores 17 are slidably received in guide tubes 25 mounted in the cylinder head 14, respectively. Coiled valve springs 27 are mounted between the cylinder head 14 and retainers 26 mounted at upper ends of the stems 24 projecting upwards from the guide tubes 25, so as to surround the stems 24, so that the exhaust valves VE are biased by the valve springs 27 in a direction to close the exhaust valve bores 17.

A cam shaft 28 parallel to an axis of a crankshaft (not shown) is rotatably disposed between the intake valves VI and the exhaust valves VE, so that they are located lower than upper ends of the intake valves VI and upper ends of the exhaust valves VE. The cam shaft 28 is operatively connected to the crankshaft in such a manner that it is rotated in a counterclockwise direction as viewed in FIG. 1 with a reduction ratio of 1/2. Moreover, an oil bath 30 is defined in an upper surface of the cylinder head 14, and the cam shaft 28 is disposed at a location at which an intake-side valve operating cam 29I and an exhaust-side valve operating cam 29E can be submerged in an oil in the oil bath 30.

An intake-side valve operating device 31I~ is provided between the intake valves VI and the intake-side valve operating cam 29I of the cam shaft 28, and is capable of converting the rotating movement of the cam shaft 28 into the opening and closing movement of the intake valves VI. An exhaust-side valve operating device 31$E_1$ is provided between the exhaust valves VE and the exhaust-side valve operating cam 29E of the cam shaft 28, and is capable of converting the rotating movement of the cam shaft 28 into the opening and closing movement of the exhaust valves VE.

The exhaust-side valve operating device 31$E_1$ includes a rocker arm shaft 32 fixedly disposed and having an axis parallel to the cam shaft 28, and a rocker arm 33 provided between the exhaust valves VE and the exhaust-side valve operating cam 29E and rotatably carried on the rocker arm shaft 32. A cam slipper 34 is provided at one end of the rocker arm 33 to come into contact with the exhaust-side valve operating cam 29E, and a pair of tappet screws 35 are threadedly inserted into the other end of the rocker arm 33 to come into contact with the upper ends of the exhaust valves VE, so that the advanced and retreated positions thereof can be regulated.

The intake-side valve operating device $^{3}$IIiincludes a power transmitting means 36, and an electric actuator 51$_1$ fixed to a head cover 52.

Figure 2:
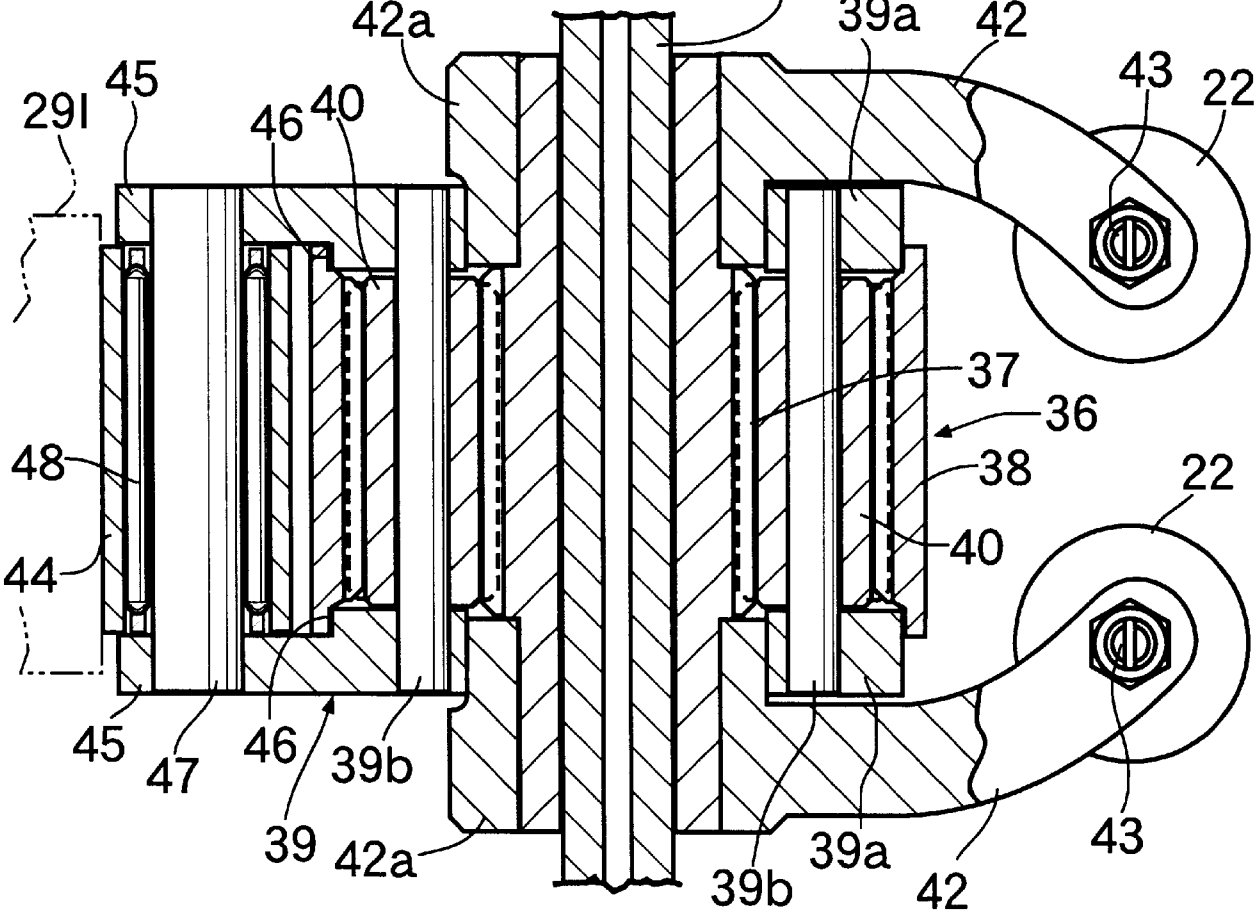
Figure 3:
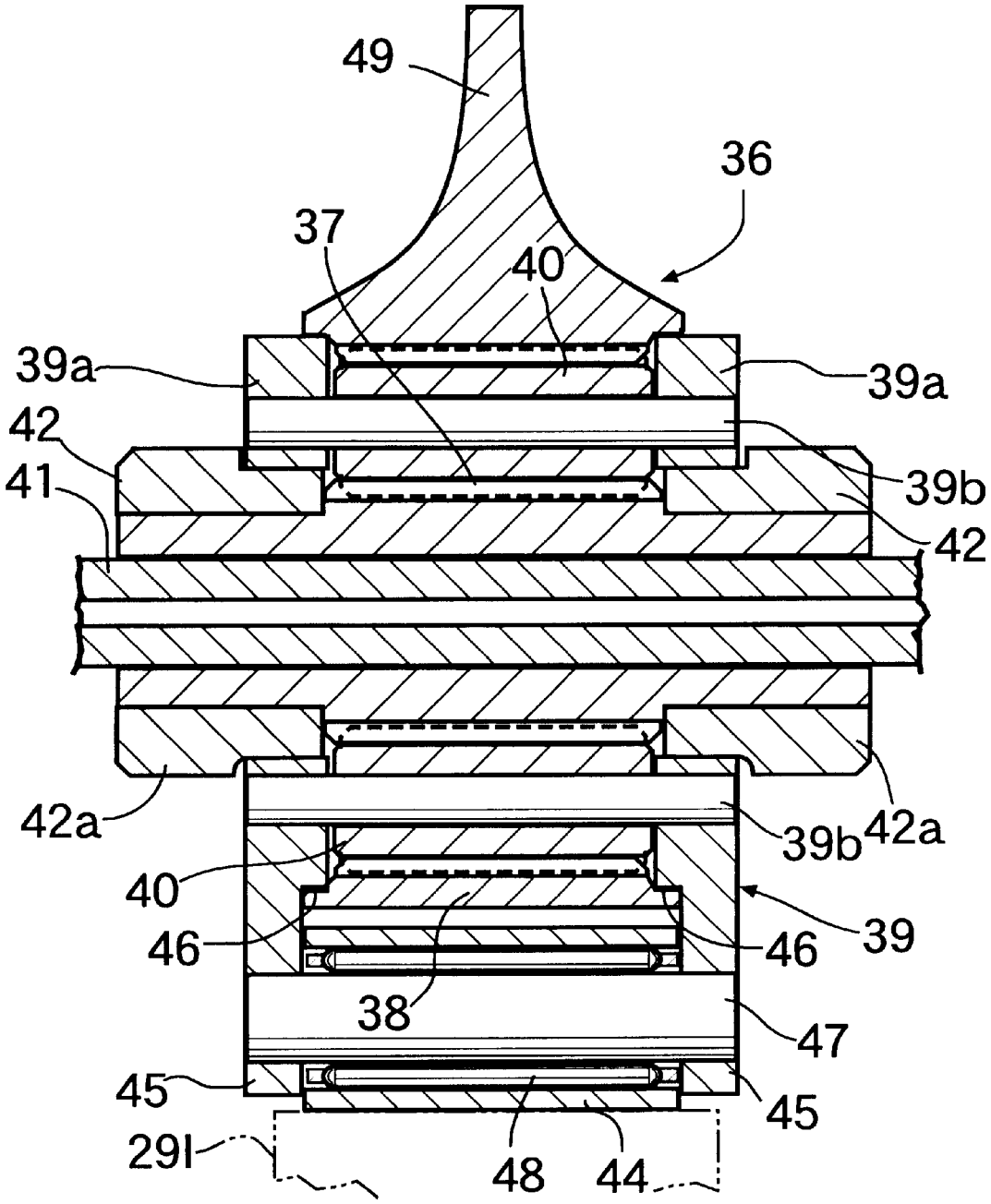

Referring to FIGS. 2 and 3, the power transmitting means 36 is formed into a planetary gear type and comprises a sun gear 37 as an inner ring which is supported on a support shaft 41 supported in the cylinder head 14 for rotation about an axis of the support shaft 41, a ring gear 38 which is an outer ring provided for rotation about the same axis as the sun gear 37 to surround the sun gear 37, and a carrier 39 on which planetary gears 40 which are planetary rotors are carried for rotation about an axis parallel to the axes of the sun gear 37 and the ring gear 38, and which is turned in operative association with the revolution of the planetary gears 40 around the sun gear 37.

The support shaft 41 has an axis parallel to the axis of the cam shaft 28 and is fixedly disposed between the cam shaft 28 and the intake valves VI at a location different from the axis of the cam shaft 28. By disposing the support shaft 41 in the above manner, the intake-side valve operating device $^{31I\sim}$ can be easily disposed in a common valve operating system which is conventionally employed, while avoiding that the structure between the cam shaft 28 and the intake valves VI is complicated.

A pair of connecting arms 42 extend toward the intake valves VI at locations spaced apart from each other in a tangential direction of the support shaft 41, and have base portions 42*a* which are fitted and secured to opposite sides of the sun gear 37 as first one of the three components: the sun gear 37, the ring gear 38 and the carrier 39 constituting the power transmitting means 36. Tappet screws 43 are threadedly inserted into tip ends of the connecting arms 42 to come into contact with upper ends of the stems 20 in the intake valves VI, so that the advanced and retreated positions thereof can be regulated. Thus, the sun gear 37 is operatively connected to the intake valves VI, so that the intake valve VI is opened and closed in response to the turning movement of the sun gear 37.

The carrier 39 as second one of the components constituting the power transmitting means 36 includes a pair of ring-shaped support plates 39*a* rotatably carried on the base portions 42*a* of the connecting arms 42, a plurality of, e.g., six shafts 39*b* having an axis parallel to the axis of the support shaft 41 and supported at their opposite ends on the support plates 39*a*. The planetary gears 40 meshed with the outer periphery of the sun gear 37 and the inner periphery of the ring gear 38 are rotatably carried by the shafts 39*b* disposed at locations spaced at equal distances apart from one another in the peripheral direction of the support shaft 41.

The support plates 39*a* included in the carrier 39 are integrally provided with roller retaining arms 45 extending on the side of the intake-side valve operating cam 29I. A roller 44 longer than the entire axial length of the planetary gears 40 is carried on tip ends of the roller retaining arms 45. The roller retaining arms 45 are extended on the side of the cam shaft 28 so as to form steps 46 between inner surfaces of the roller retaining arms 45 and inner surfaces of the support plates 39*a*. A roller shaft 47 having an axis parallel to the axis of the support shaft 41 is fixed at its opposite ends at tip ends of the roller retaining arms 45. A needle bearing 48 is interposed between the roller shaft 47 and the roller 44 which is in rolling contact with the intake-side valve operating cam 29I having a width along the axis of the cam shaft 28 larger than the entire axial length of the roller 44.

Thus, the carrier 39 is operatively connected to the intake-side valve operating cam 29I of the cam shaft 28, so that the carrier 39 is driven in turning movement by the intakeside valve operating cam 29I in response to the rotation of the cam shaft 28.

The ring gear 38 which is a third one of the three components constituting the power transmitting means 36 is rotatably carried on the carrier 39. Namely, the ring gear 38 formed into a cylindrical shape is rotatably supported at its opposite ends on outer peripheral edges of inner surfaces of the support plates 39*a*. The ring gear 38 is rotatably supported at its opposite ends on the steps 46 formed between the support plates 39*a* and the roller retaining arms 45 in locations corresponding to the roller retaining arms 45 connected to the support plates 39*a*.

The ring gear 38 is integrally provided with a control arm 49 extending in a direction perpendicular to the axis of the support shaft 41. An actuator 51$_1$ is fixed to the head cover 52 and has a rod 57 which is in contact with the control arm 49 in a substantially perpendicular direction.

Figure 4:
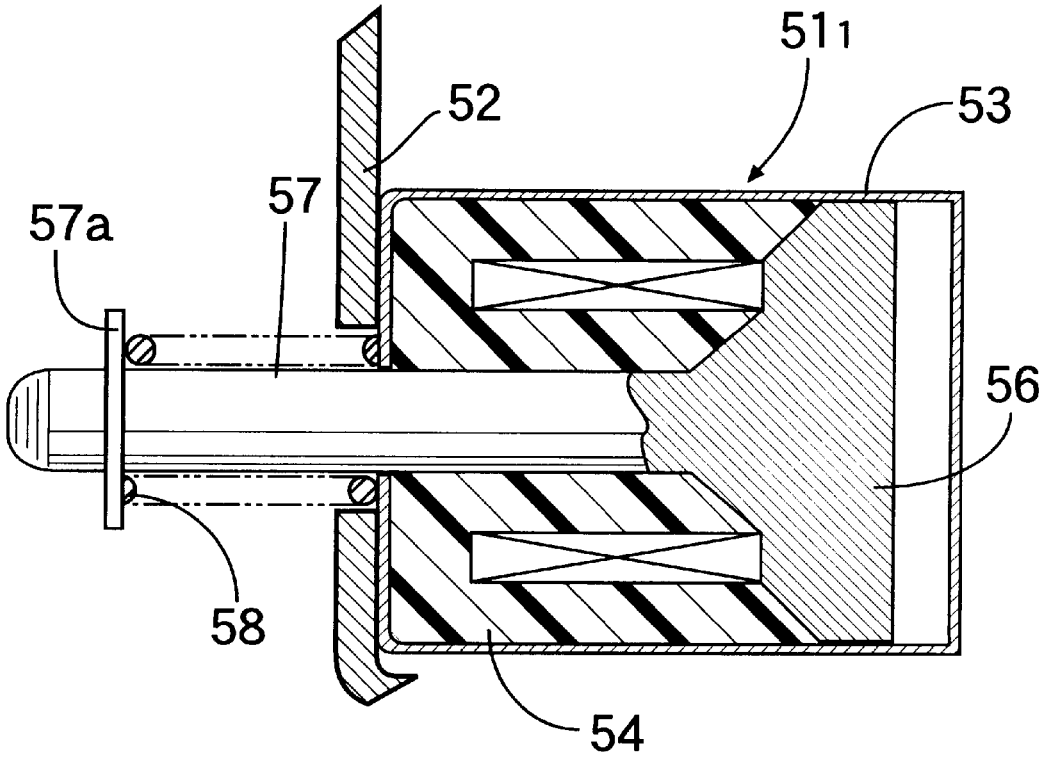

Referring to FIG.4, the actuator $51_1$ includes a housing 53 formed into a cylindrical shape, an electromagnet 54 fixedly disposed in one end of the housing 53, a plunger 56 disposed in an opposed relation to the electromagnet 54 within the housing 53, a rod 57 axially movably disposed to extent through a central portion of the electromagnet 54 and the housing 53 and connected at its base end to the plunger 56, and a return spring 58 mounted between the housing 53 and a spring receiving portion 57*a* fixed to a tip end of the rod 57 outside the housing 53. The actuator $51_1$ is fixed to the head cover 52, so that the tip end of the rod 57 can be put into abutment against the control arm 49 of the ring gear 39. Moreover, the spring load of the return spring 58 is set at an extremely small value, as compared with the spring load of the valve spring 23.

With such actuator $51_1$, the rod 57 is moved axially between a position in which the plunger 56 is attracted to the electromagnet 54 and a position in which the plunger 56 is received by the other closed end of the housing 53, and the tip end of the rod 57 is normally in contact with the control arm 49 under the action of the return spring 58.

The operation of the actuator $51_1$ is controlled by a control means $60_1$. During operation of the intake valves VI in the closing direction within a period while the intake valves VI are open, the control means $60_1$ stops the supplying of electric power to the electromagnet 54 to stop the delivery of a driving force from the actuator $51_1$ to the control arm 49 of the power transmitting means 36.

Figure 5:
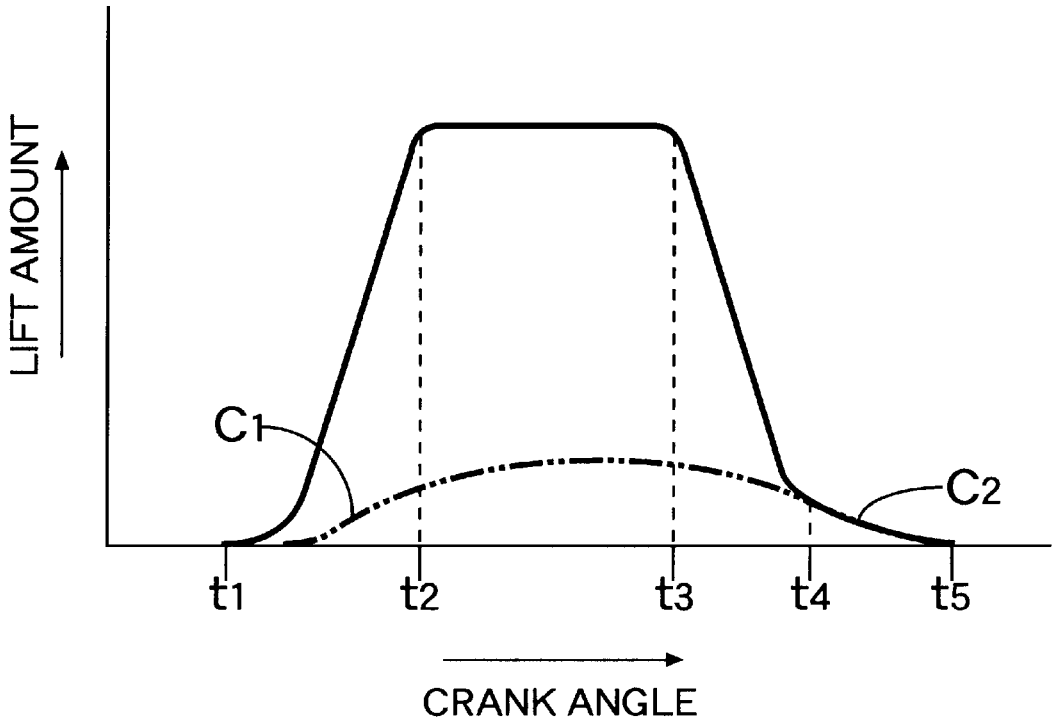

The lift characteristic of the intake valve VI is as shown in FIG. 5 depending on the power inputted from the actuator $51_1$ to the power transmitting means 36 and the power inputted from the intake-side valve operating cam 29I to the power transmitting means 36.

In FIG. 5, the intake-side valve operating cam 28I has a cam profile which provides a lift characteristic as shown by a dashed line, when the intake valves VI are opened and closed only by the intake-side valve operating cam 29I. This cam profile provides a lift characteristic in which a gentle buffer curve $C_1$ is described at the start of the operation of the intake valves VI, and a gentle buffer curve $C_2$ is described immediately before closing and seating of the intake valves VI.

Figure 6:
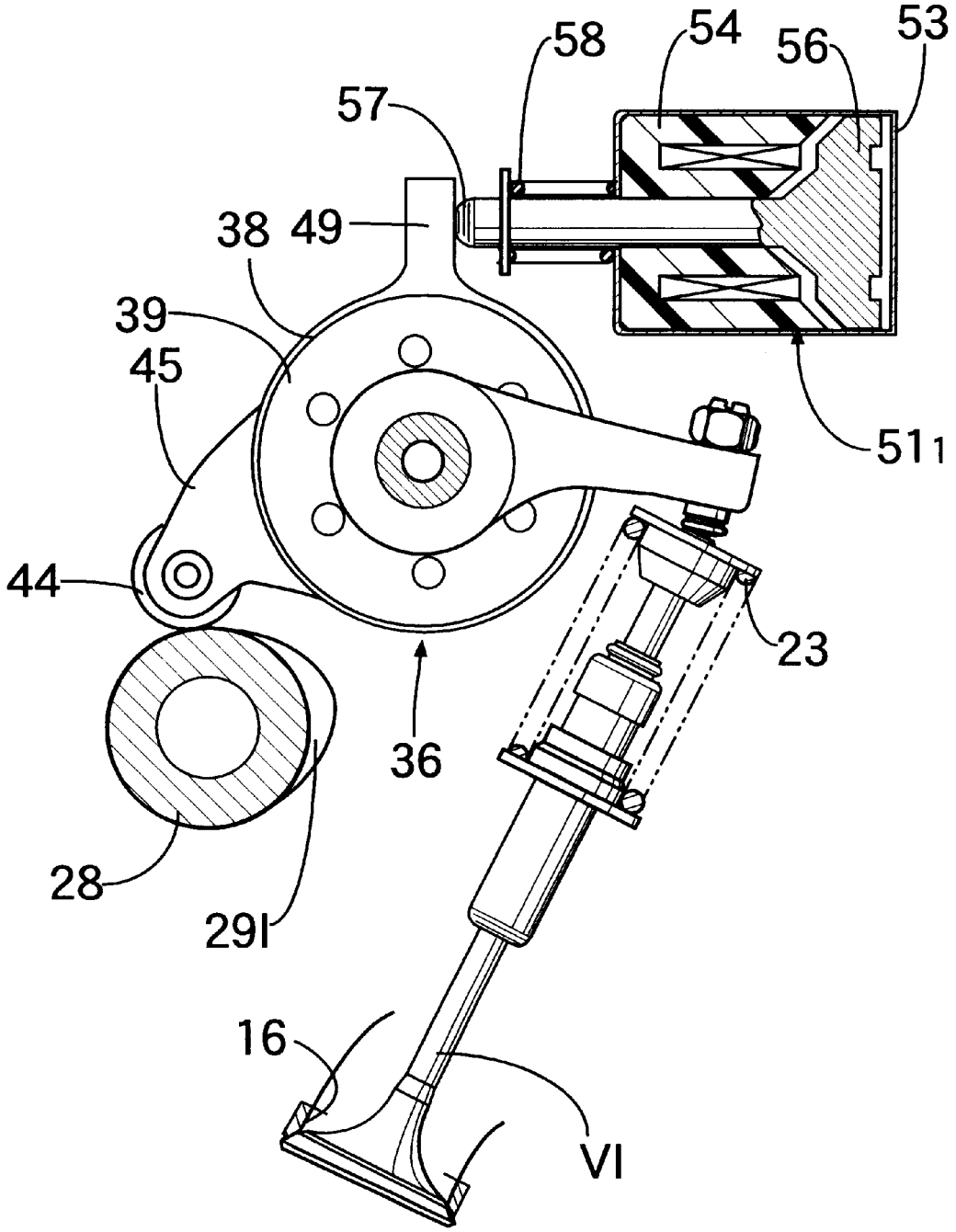

The actuator $51_1$ can start the opening of the intake valves VI at a time point $t_1$ which is a time of opening of the intake valves VI, regardless of the valve-opening starting time point determined by the intake-side valve operating cam 29I, and as shown in FIG. 6, the electromagnet 54 is excited to attract the plunger 56. Thus, the sun gear 37 is turned by pushing the control arm 49 of the ring gear 38 by the rod 57, thereby operating the intake valves VI in an opening direction. In this case, when the roller retaining arms 45 are pushed by the intake-side valve operating cam 29I through the roller 44, the power from the actuator $51_1$ and the power from the intake-side valve operating cam 29I are synergetically applied to the sun gear 37, whereby the intake valves VI are lifted in a total lift amount obtained by addition of a lift amount attendant on an amount of operation of the actuator $51_1$ and a lift amount provided by the intake-side valve operating cam 29I. Thus,when the maximum lift amount of the intake valve VI is, for example, 8 mm, the actuator $51_1$ can bear, for example, 7 mm, and the intake-side valve operating cam 29I can bear, for example, 1 mm.

Figure 7:
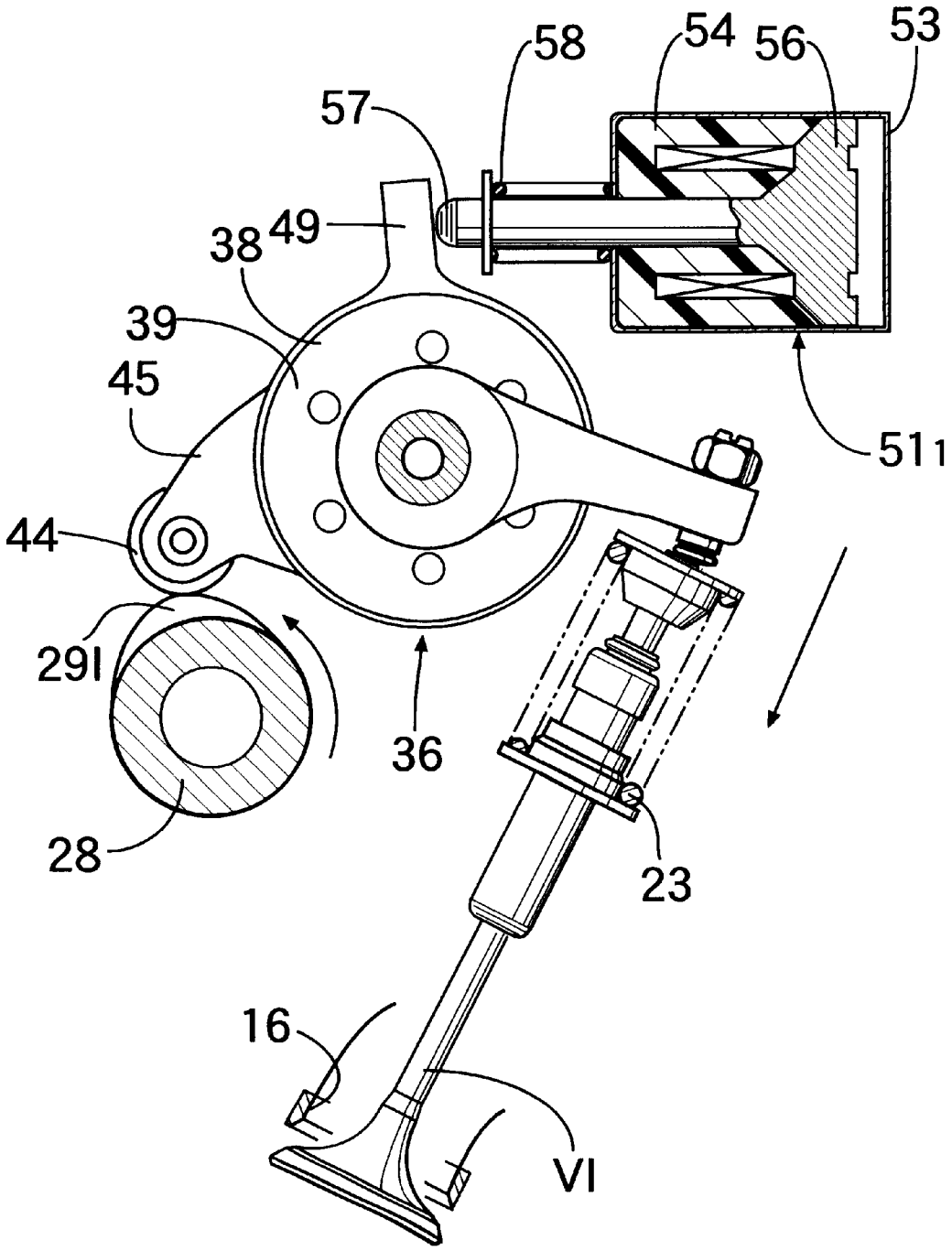
Figure 8:
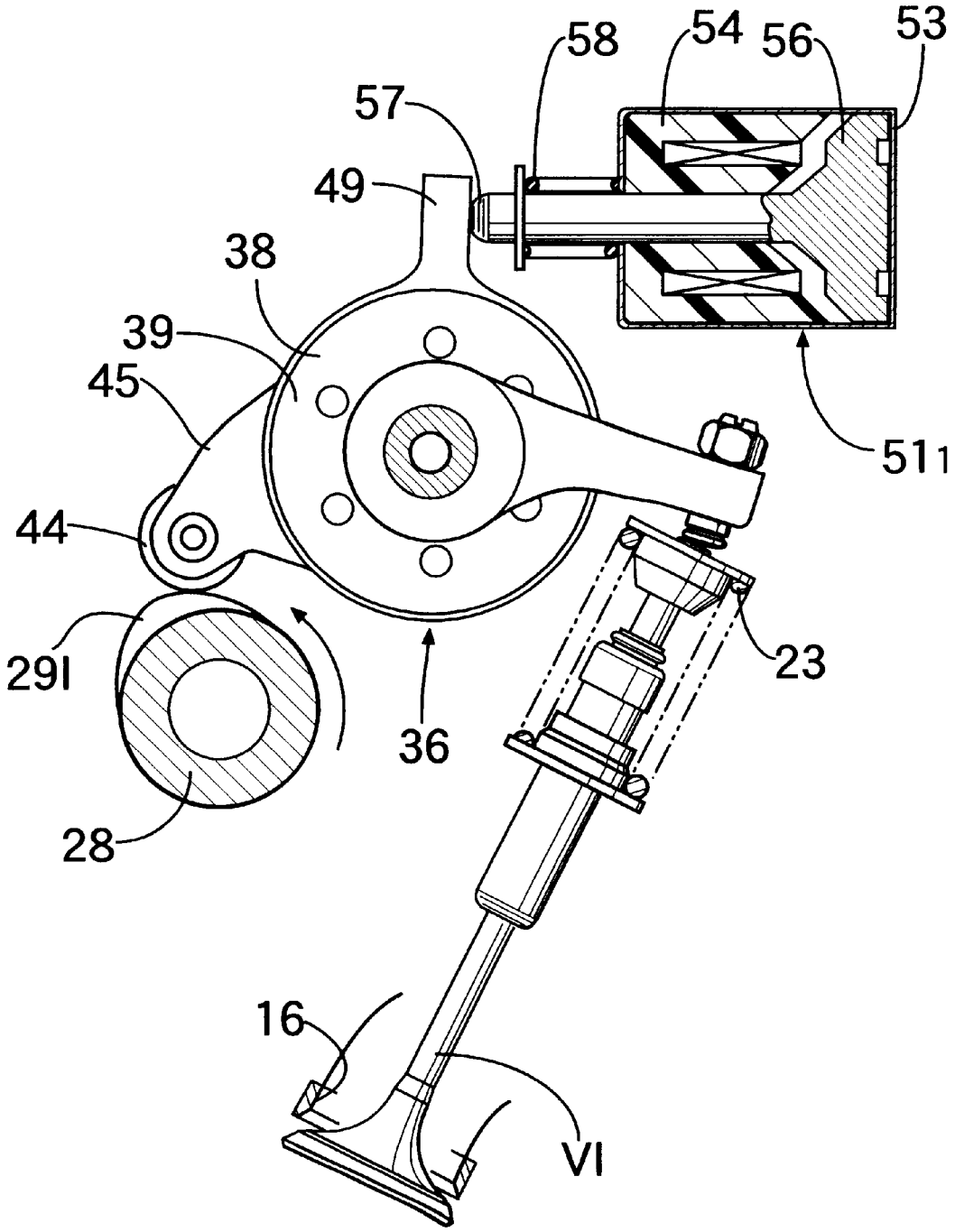
Figure 9:
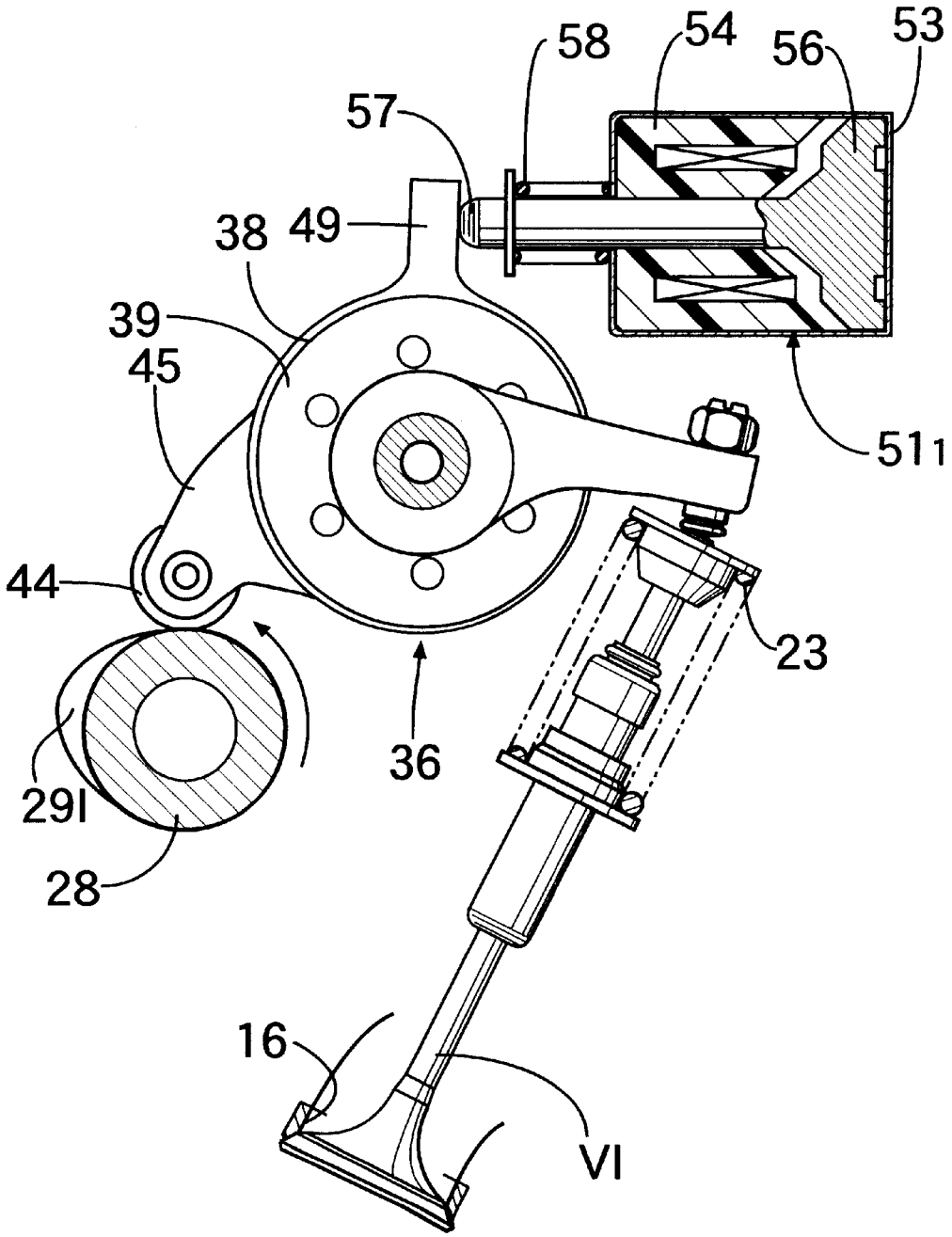

After a time point $t_2$ when the lift amount of the intake valves VI becomes maximum, the plunger 56 is left attracted to the electromagnet 54, as shown in FIG. 7. When the exciting of the electromagnet 54 is stopped at a time point $t_3$, the intake valves VI start to be closed by the spring force of the valve spring 23, and the actuator $51_1$ causes the rod 57 to be pushed by the control arm 49, as shown in FIG. 8, whereby the plunger 56 is brought into a state in which it is in abutment against the other closed end of the housing 53. Thus, after a time point $t_4$ immediately before closing and seating of the intake valves VI, the intake valves VI show a lift characteristic determined by the cam profile of the intake-side valve operating cam 29I, and are slowly closed and seated according to the buffer curve $C_2$.

After closing and seating of the intake valves VI, the rod 57 of the actuator $51_1$ remains in abutment against the control arm 49 under the action of the spring force of the return spring 58. However, the return spring 58 cannot disturb the operation of the intake valves VI, because the spring load of the return spring 58 is set at a value small enough to provide no problem, as compared with the spring load of the valve spring 23.

The operation of the first embodiment will be described below. Since the intake-side valve operating cam 29I bears a portion of the lift amount of the intake valve VI, the valve opening power borne by the actuator $51_1$ may be small, as compared with a system designed so that the intake valves VI are opened and closed only by the actuator $51_1$. Therefore, the amount of electric power consumed by the actuator $51_1$ is also small and hence, the size of the actuator $51_1$ can be reduced.

Moreover, the operation al characteristic can be changed by controlling the timing of operation of the actuator $51_1$.

When the actuator $51_1$ is broken down, the intake valves VI can be driven by only the intake-side valve operating cam 29I. When the break-down of the actuator $51_1$ is taken into consideration, a cam profile of the intake-side valve operating cam 29I may be established, so that a lift characteristic shown by the two-dot dashed line in FIG. 5 forms a higher mountain-shaped curve. If such profile is established, the driving of the intake valves VI can be ensured despite the break-down of the actuator $51_1$.

The power transmitting means 36 is provided between the intake-side valve operating cam 29I and the intake valves VI, and the actuator $51_1$ is connected to one of the components of the power transmitting means 36, e.g., the ring gear 38. The power transmitting means 36 is of the planetary gear type and hence, when the powers from the intake-side valve operating cam 29I and the actuator $51_1$ which are independent from each other are simultaneously applied to the power transmitting means 36, both the powers can be synergetically transmitted to the intake valves VI, while avoiding the creation of a collision point.

Moreover, since the power transmitting means 36 is of the planetary type comprising the sun gear 37, the ring gear 38 and the carrier 39 which are disposed for rotation about the same axis, the power transmitting means 36 can be made compact and thus, the size of the intake-side valve operating device $31I_1$ can be reduced. Further, the operational characteristic of the intake valves VI can be accurately controlled by the meshed connection of the components 37, 38 and 39 constituting the power transmitting means 36 with one another. Moreover, since the ring gear 38, the planetary gears 40 and the carrier 39 are disposed between the pair of connecting arms 45 connected respectively to the intake valves VI, the power transmitting means 36 can be made further compact.

In such power transmitting means 36, the rotational amount of the carrier 29I is remarkably smaller than the rotational amount of the sun gear 37; the carrier 39 is operatively connected to the intake-side valve operating cam 29I of the cam shaft 28, and the sun gear 37 is operatively connected to the intake valves VI. Therefore, the size of the intake-side valve operating cam 29I relative to the lift amount required for the intake valves VI, i.e., the rotational amount of the sun gear 37 can be remarkably reduced. Thus, the load received by the carrier 39 from the intake-side valve operating cam 29I can be relatively decreased to contribute to the alleviation of valve operating load. In addition, since the roller 44 supported on the roller retaining arms 45 of the carrier 39 is in rolling contact with the intake-side valve operating cam 29I, the valve operating load can be further alleviated. Further, because the intake-side valve operating cam 29I is relatively small, a space required for the rotation of the valve operating cam 29I and a space required for the operation of the pair of roller retaining arms 45 integral with the carrier 39 are relatively small. Therefore, a valve operating chamber in which the intake-side valve operating device $\mathbf{31I_1}$ is disposed can be made compact.

Since the intake-side and exhaust-side valve operating cams 29I and 29E are submerged in the oil within the oil bath 30 defined in the upper surface of the cylinder head 14, the power transmitting means 36 can be sufficiently lubricated by raking up the oil by the intake-side and exhaust-side valve operating cams 29I and 29E. In this case, the oil raked up by the intake-side and exhaust-side valve operating cams 29I and 29E can be effectively scattered toward the power transmitting means 36 to effectively lubricate the power transmitting means 36.

Further, the support shaft 41 supporting the power transmitting means 36 is disposed in parallel to the cam shaft 28 at a location offset from the axis of the cam shaft 28, and the cam shaft 28 can formed into a simple structure in which the valve operating cams 29I and 29E are only provided thereon, as in the prior art valve operating system. Additionally, since the pair of roller retaining arms 45 extending on the side of the intake-side valve operating cam 29I are integrally provided on the carrier 39, the rigidity of the carrier 39 itself can be enhanced, and the stable operation of the ring gear 38 and the planetary gear 40 can be carried out to enhance the accuracy of the operational characteristic of the intake valves VI.

In addition, since the roller 44 is supported on the roller retaining arms 45 to come into rolling contact with the intake-side valve operating cam 29I, the resistance of friction between the intake-side valve operating cam 29I and the carrier 39. Moreover, the carrier 39 is comprised of the pair of support plates 39*a* disposed on the opposite sides of the planetary gears 40, and the shafts 39*b* which are provided to extend between the support plates 39*a* and on which the planetary gears 40 are rotatably carried. The opposite ends of the roller shaft 47 on which the roller 44 longer than the entire axial length of the planetary gears 40 is rotatably supported, are fixed to the roller retaining arms 45, and the steps 46 supporting the ring gear 38 are formed between the inner surfaces of the roller retaining arms 45 and the inner surfaces of the support plates 39*a*. Therefore, the structure in which the ring gear 38 is rotatably carried on the outer periphery of the carrier 39, can be simply constructed, but also because the axial length of the roller is relatively large, the area of contact between the roller 44 and the intake-side valve operating cam 29I can be relatively large, whereby the resistance of friction between the intake-side valve operating cam 29I and the carrier 39 can be further reduced.

Further, the intake-side valve operating cam 29I has the cam profile which provides the lift characteristic in which the gentle buffer curves $C_1$ and $C_2$ are described at the start of the opening of the intake valves VI and immediately before the closing and seating of the intake valves VI, when the intake valves VI are opened and closed. The control means $\mathbf{60_1}$ controls the actuator $\mathbf{51_1}$ so that the delivery of the driving force to the power transmitting means 36 is stopped at least immediately before the closing and seating of the intake valve VI during operation of the intake valves VI in the closing direction within the period while the intake valves VI are open. Therefore, immediately before the closing and seating of the intake valves VI, the intake valves VI are gently seated according to the cam profile of the intake-side valve operating cam 29I, whereby the occurrence of the bouncing of the intake valves VI can be prevented. Thus, it is unnecessary to finely control the operation of the actuator $\mathbf{51_1}$ by the control means $\mathbf{60_1}$ in order to provide the gentle operation of the intake valves VI, whereby the control of the operation of the actuator $\mathbf{51_1}$ can be simplified.

Figure 10:
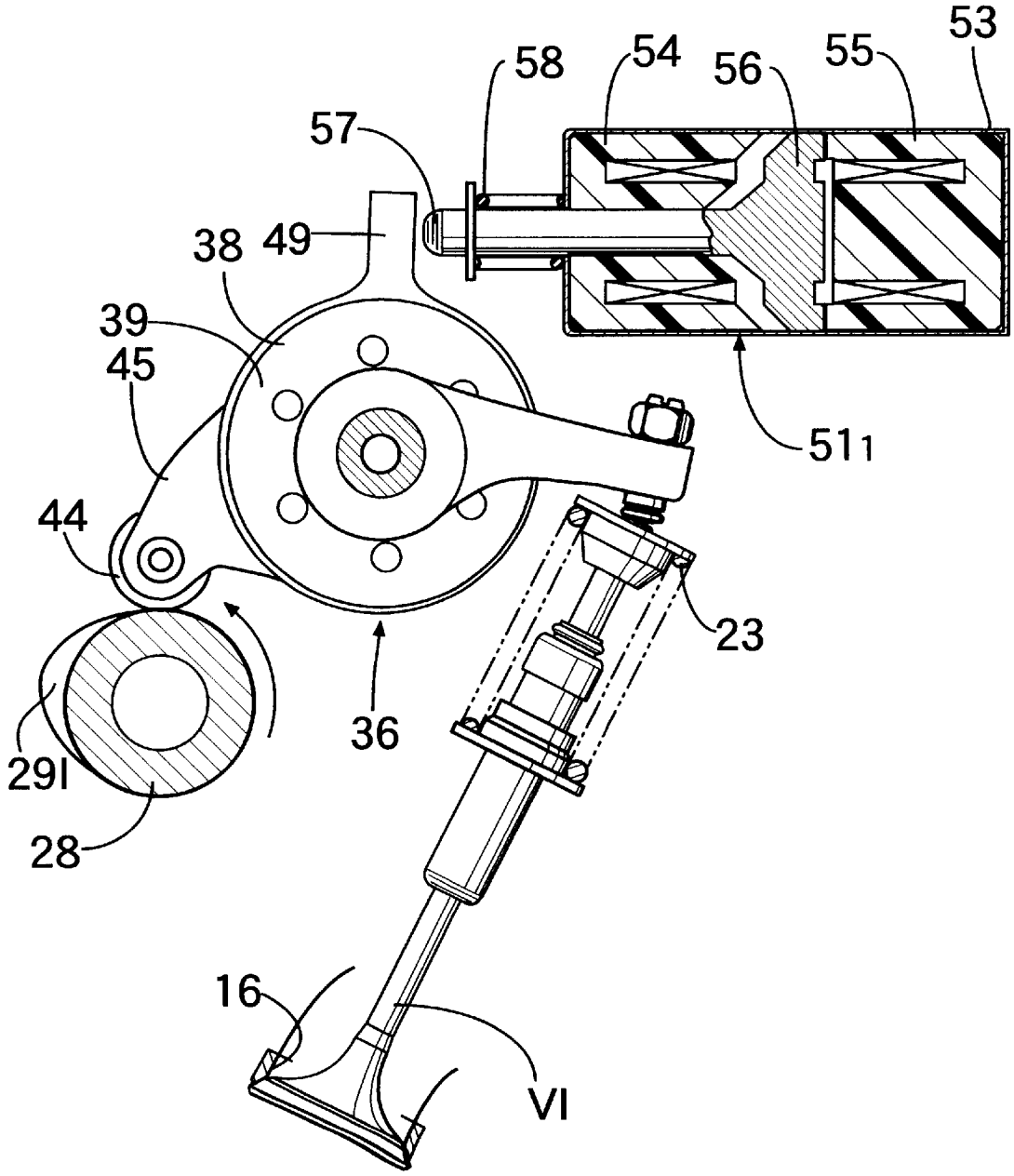
FIG. 10 is a schematic vertical sectional view of an intake-side valve operating device in a closed state of an intake valve according to a second embodiment of the present invention.

FIG. 10 is a simplified vertical sectional view of an intake-side valve operating device in a valve-closed state according to a second embodiment of the present invention, wherein portions or components corresponding to those in the first embodiment are designated by like reference characters.

The intake-side valve operating device includes a power transmitting means 36 provided between an intake-side valve operating cam 29I on a cam shaft 28 and an intake valve VI, and an electric actuator $\mathbf{51_2}$ connected to a control arm 49 provided on a ring gear 38 of the power transmitting means 36.

The actuator $\mathbf{51_2}$ includes a housing 53 formed into a cylindrical shape, a first electromagnet 54 fixedly disposed in one end of the housing, a second electromagnet 55 fixedly disposed in the other end of the housing 53, a plunger 56 accommodated in the housing 54 between both the electromagnets 54 and 55, a rod 57 axially movably provided to extend through a central portion of the first electromagnet 54 and the housing 53 and connected at its base end to the plunger 56, and a return spring 58 mounted between the housing 53 and a spring receiving portion 57*a* fixed to a tip end of the rod 57 outside the housing 53.

In this actuator $\mathbf{51_2}$ the plunger 56 and thus, the rod 57 are reciprocally moved by switching-over the excitation and deexcitation of the first and second electromagnets 54 and 55. The control means $\mathbf{60_1}$ (see FIG. 1) excites the first electromagnet 54 and deexcites the second electromagnet 55, when the intake valve VI is operated in an opening direction; and excites the second electromagnet 55 and deexcites the first electromagnet 54, when the intake valve VI is operated in a closing direction. When the intake valve VI is in a closed state, the plunger 56 remains attracted to the second electromagnet 55, as shown in FIG. 7, and a gap is produced between the tip end of the rod 57 and the control arm 49, whereby the spring force of the return spring 58 cannot act on the power transmitting means 36.

In the second embodiment, the second electromagnet 55 remains excited in the closed state of the intake valve VI and hence, the amount of electric power consumed is slightly larger than that in the first embodiment, but the actuator $\mathbf{51_2}$ and the intake-side valve operating cam 29I cooperate with each other to open the intake valve VI. Therefore, the amount of electric power consumed in the actuator $\mathbf{51_2}$ can be decreased to provide a reduction in size of the actuator $\mathbf{51_2}$, as compared with a system designed so that the intake valves VI are opened and closed by only the actuator $\mathbf{51_2}$.

Figure 11:
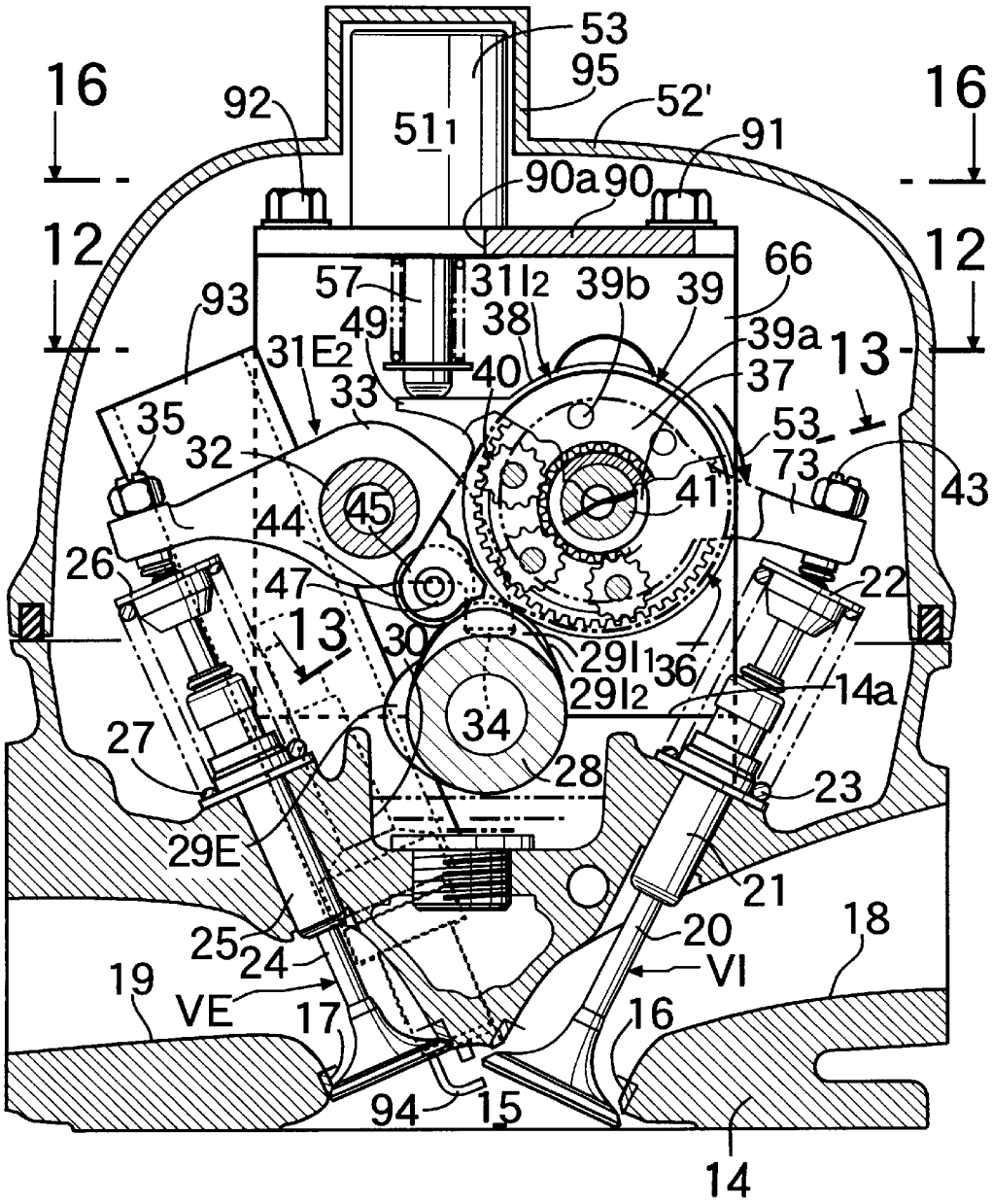
Figure 12:
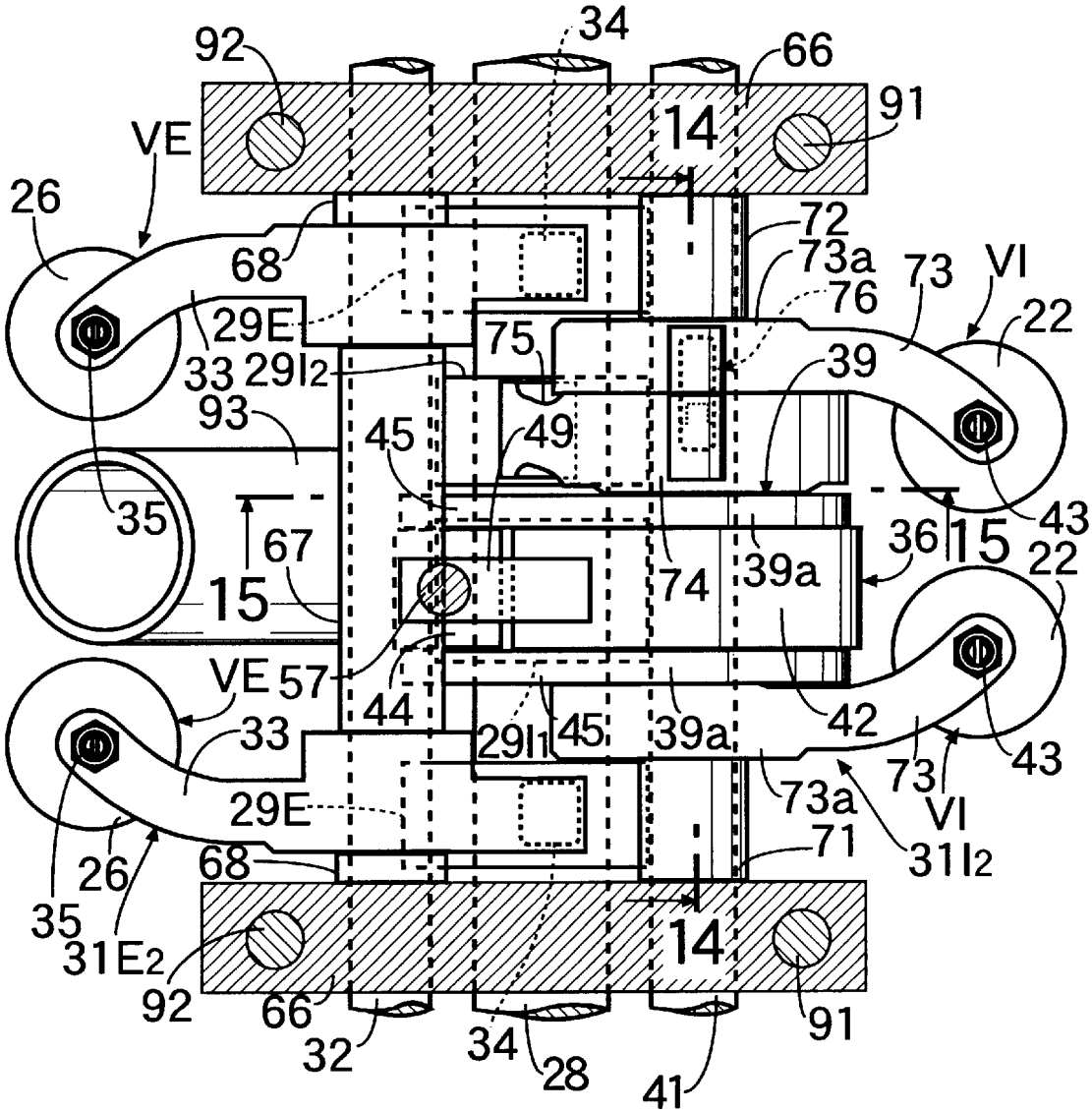

A third embodiment of the present invention will now be described with reference to FIGS. 11 to 19. Referring first to FIGS. 11 and 12, support portions 14*a* are provided on a cylinder head 14 on opposite sides of a combustion chamber 15 in each of cylinders, and the cam shaft 28 is rotatably carried between the support portions 14*a* and shaft holders 66 fastened to the support portions 14*a*. The rocker arm shaft 32 is fixedly supported by the shaft holders 66.

An exhaust-side valve operating device 31$E_2$ includes a pair of a rocker arms 33 carried on the rocker arm shaft 32 in correspondence to exhaust valves VE. Mounted on the rocker arm shaft 32 are a cylindrical spacer 67 for maintaining the spacing between both the exhaust-side rocker arms 33, and a cylindrical spacers 68 for maintaining the spacing between the exhaustside rocker arms 33 and the shaft holders 66.

Figure 13:
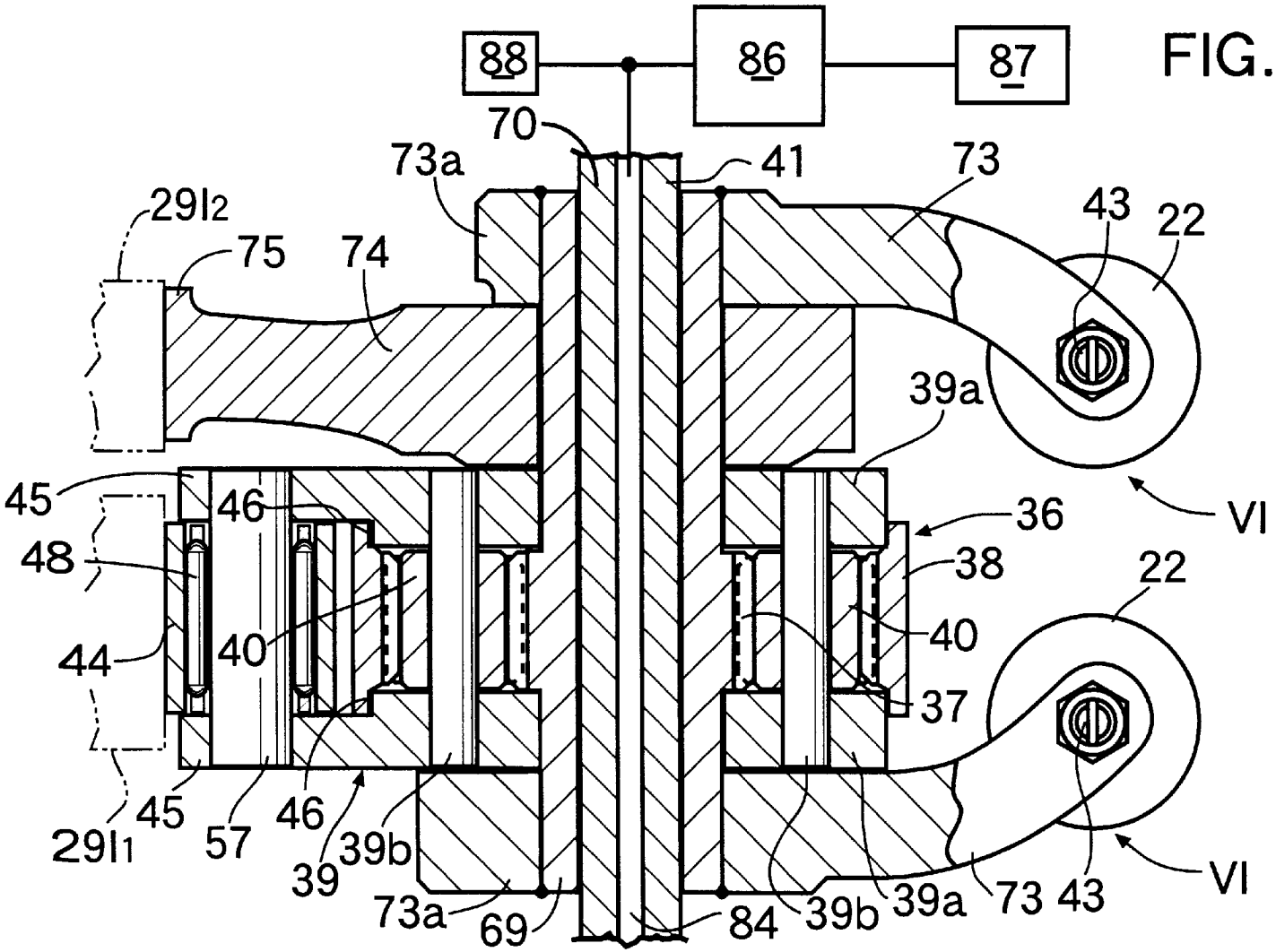
Figure 14:
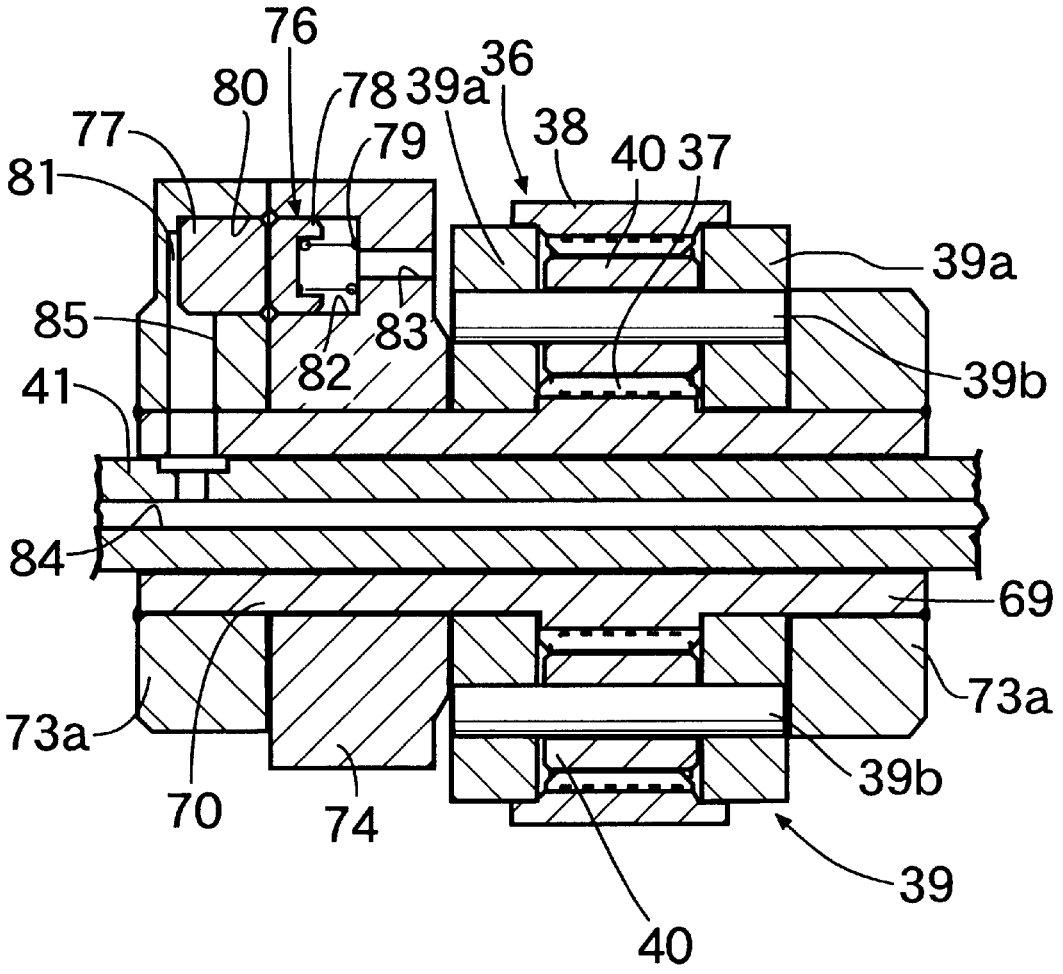

Referring to FIGS. 13 and 14, an intake-side valve operating device 31$I_2$ includes a planetary gear-type power transmitting means 36 for each of the cylinders. The power transmitting means 36 has a sun gear 37 rotatably supported on a support shaft 41 which is fixedly disposed between the cam shaft 28 and the intake valves VI and has an axis parallel to the cam shaft 28. The support shaft 41 is fixedly supported by the shaft holders 66 which support the rocker arm shaft 32.

The sun gear 37 which is one of the three components constituting the power transmitting means 36, i.e., the sun gear 37, the ring gear 38 and the carrier 39, is integrally provided with cylindrical portions 69 and 70 which extend on opposite sides of the sun gear 37 to surround the support shaft 41. Cylindrical spacers 71 and 72 are mounted on the support shaft 41 between outer ends of the cylindrical portions 69 and 70 and the shaft holders 66.

Base portions 73*a* of a pair of connecting arms 73 extending toward the intake valves VI are fitted and secured to the outer ends of the cylindrical portions 69 and 70 integral with the sun gear 37. Tappet screws 35 are threadedly inserted into tip ends of the connecting arms 73 to come into contact with upper ends of the stems 20 in the intake valves VI, so that the advanced and retreated positions thereof can be regulated. Thus, the sun gear 37 is operatively connected to the intake valves VI, so that the intake valves VI are opened and closed in response to the rotation of the sun gear 37.

The carrier 39 which is one of the components constituting the power transmitting means 36 includes a pair of ring-shaped support plates 39*a* rotatably carried on the cylindrical portions 69 and 70 of the sun gear 37, and a plurality of, e.g., six shafts 39*b* each supported at opposite ends on the support plates 39*a*. Planetary gears 40 meshed with an outer periphery of the sun gear 37 and an inner periphery of the ring gear 38 are rotatably carried on the shafts 39*b* disposed at locations spaced apart from one another at equal distances in a circumferential direction of the support shaft 41.

A roller 44 is carried at tip ends of roller retaining arms 45 which are integrally provided on the support plates 39*a* included in the carrier 39. The roller 44 is in rolling contact with the first intake-side valve operating cam 29$I_1$ provided on the cam shaft 28.

Thus, the carrier 39 is operatively connected to the first intake-side valve operating cam 29$I_1$ of the cam shaft 28, so that the carrier 39 is driven in turning movement by the first intake-side valve operating cam 29$I_1$ in response to the rotation of the cam shaft 28.

The ring gear 38 which is remaining one of the three components constituting the power transmitting means 36 is rotatably carried by the carrier 39.

Figure 15:
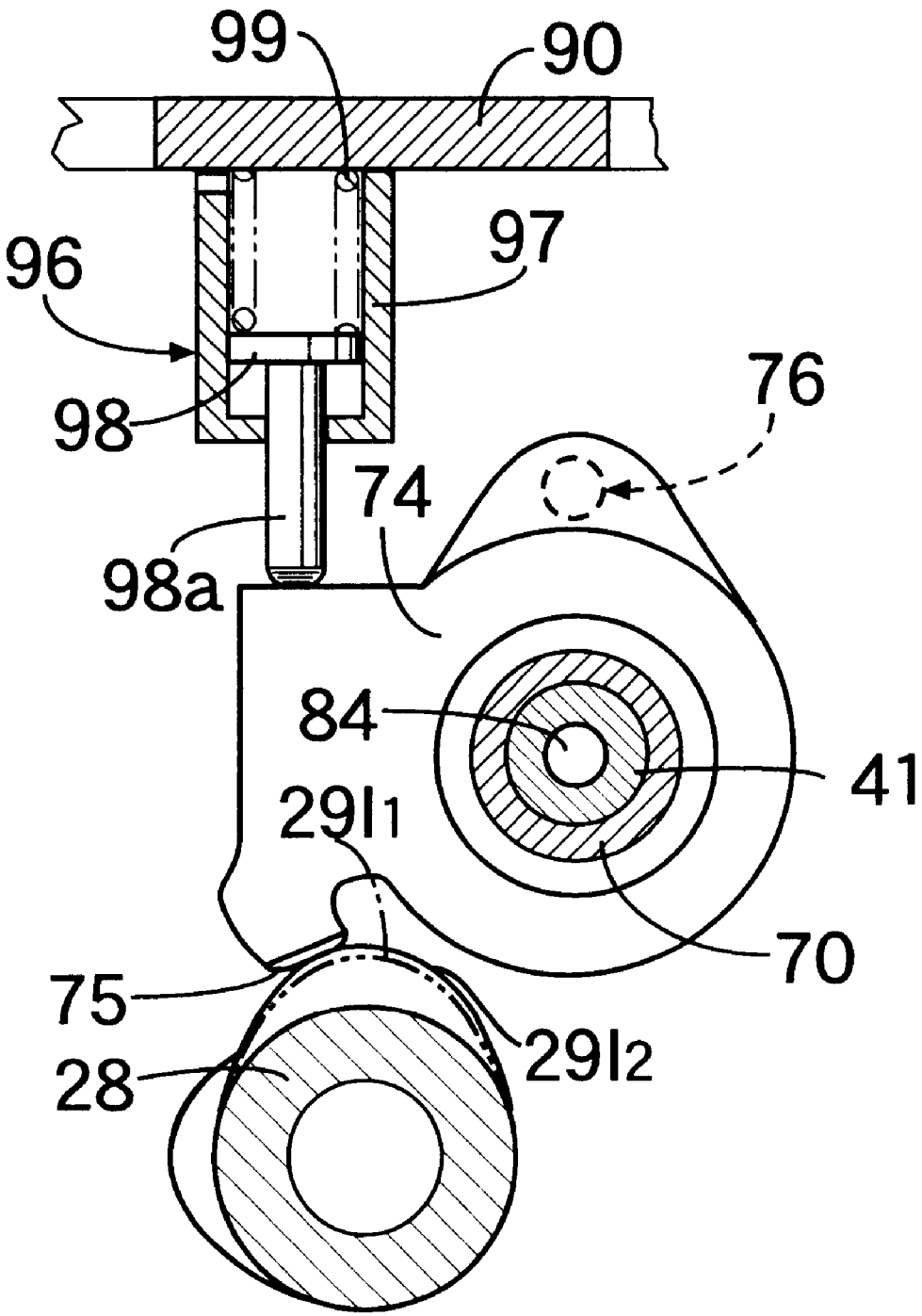

Referring also to FIG. 15, a cam slipper 75 integrally provided on the intake-side rocker arm 74 is in sliding contact with a second intake-side valve operating cam 29$I_2$ provided on the cam shaft 28. The intake-side rocker arm 74 is turnably carried on the cylindrical portion 70 of the sun gear 37 in such a manner that it is clamped between one of the pair of support plates 39*a* include d in the carrier 39 and the base portion 73*a* of one of the connecting arms 73 . The intake-side valve operating cam $^{29I}{}_1$ has a cam profile corresponding to a lower-speed operational range of the engine, while the second intake-side valve operating cam 29$I_2$ has a cam profile corresponding to a higher-speed operational range of the engine.

A hydraulic connection switch-over means 76 is provided between the intake-side rocker arm 74 and the base portion 73a of the one connecting arm 73 and capable of switching-over the connection and disconnection between the rocker arm 74 and the one connecting arm 73, i. e., the sun gear 37.

The connection switch-over means 76 includes a connecting piston 77 which is slidably received in the base portion 73a of the one connecting arm 73, so that it can be fitted into the intake-side rocker arm 74, a bottomed cylindrical interlocking member 78 which is slidably received in the intake-side rocker arm 74 for movement with the connecting piston 77, and a return spring 79 mounted between the interlocking member 78 and the intake-side rocker arm 74 for exhibiting a spring force for biasing the interlocking member 78 toward the connecting piston 77.

A first bottomed slide bore 80 is provided in the base portion 73*a* of the one connecting arm 73 with its axis parallel to the axis of the support shaft 41, and opens toward the intake-side rocker arm 74. The connecting piston 77 is slidably received in the first slide bore 80 to form a hydraulic pressure chamber 81 between the piston 77 and a closed end of the first slide bore 80.

A second slide bore 82 having the same diameter as the first slide bore 80 and a smaller-diameter open bore 83 are provided in the intake-side rocker arm 74 to extend between opposite ends of the intake-side rocker arm 74 and to have axes parallel to the axis of the support shaft 41. The open bore 83 is coaxially connected to the second slide bore 82 with an annular step formed therebetween. The interlocking member 78 with its closed end in sliding contact with the connecting piston 77 is slidably received in the second slide bore 82. Further, the return spring 79 is mounted under compression between the interlocking member 78 and the step between the second slide bore 82 and the open bore 83.

An oil passage 84 is coaxially provided in the support shaft 41, and a communication passage 85 is provided in the cylindrical portion 70 of the sun gear 37 and the base portion 73*a* of the connecting arm 73 for permitting the communication between the oil passage 84 and the hydraulic pressure chamber 81 despite the turning movement of the sun gear 37.

A hydraulic pressure source is connected to the oil passage 84 through a control valve means 86, and a working oil whose hydraulic pressure can be changed to higher and lower levels by the control valve means, supplied to the oil passage 84 and thus to the hydraulic pressure chamber 81. A pressure sensor 88 for detecting the hydraulic pressure being risen to a preset pressure is added to the oil passage 84 downstream from the control valve means 86.

In such connection switch-over means 76, when the hydraulic pressure in the hydraulic pressure chamber 81 is lower, sliding faces of the connecting piston 77 and the interlocking member 78 lie between the base portion 73*a* of the connecting arm 73 and the intake-side rocker arm 74, thereby enabling the relative rotation of the connecting arm 73, i. e., the sun gear 37 and the intake-side rocker arm 74. However, when the hydraulic pressure in the hydraulic pressure chamber 81 is increased to a higher level, a portion of the connecting piston 77 is fitted into the second slide bore 82 while pushing the interlocking member 78 against the spring force of the return spring 79, whereby the base portion 73*a* of the connecting arm 73 and the intake-side rocker arm 74 are connected to each other through the connecting piston 77 and thus rotated in unison with each other. The pressure sensor 88 detects that the connecting operation of the connection switch-over means 76 has been completed, since the hydraulic pressure in the hydraulic pressure chamber 81 has been increased to the higher level.

A control arm 49 is integrally provided in the ring gear 38 of the power transmitting means 36 to extend outwards from the ring gear 38, and an electric actuator $\mathbf{51}_1$ or $\mathbf{51}_2$ is connected to the control arm 49.

An actuator holder 90 is secured to a housing 53 of the actuator $\mathbf{51}_1$. The actuator holder 90 is mounted to a pair of shaft holders 66 which are fastened to the support portion 14*a* of the cylinder head 14 on opposite sides of the combustion chamber 15 in each of the cylinders for fixedly supporting the rocker arm shaft 32 and the support shaft 41 and for supporting the cam shaft 28 for rotation between the support portions 14*a*. A tip end of the rod 57 of the actuator $\mathbf{51}_1$ is in contact with the control arm 49.

Figure 16:
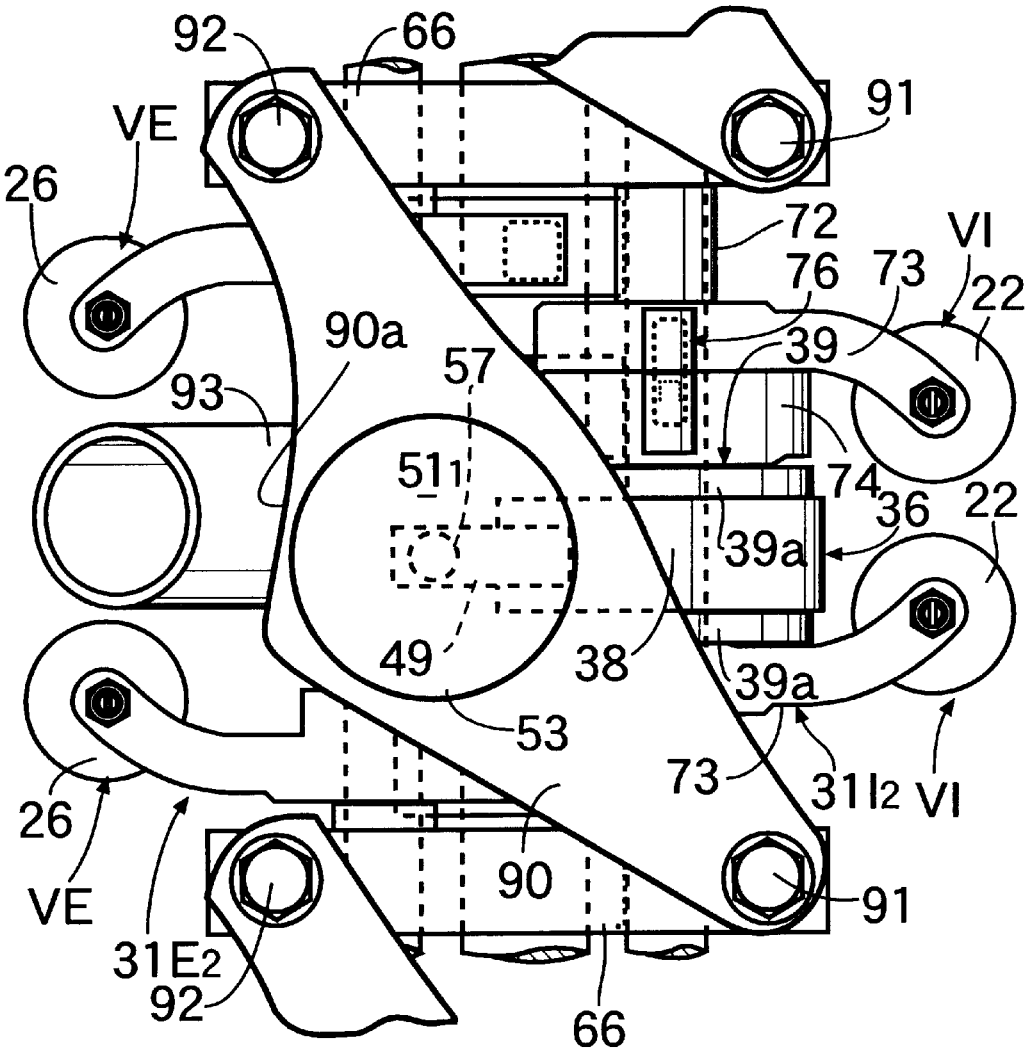

Referring also to FIG. 16, the actuator holder 90 is mounted to extend between the pair of shaft holders 66 disposed on the opposite sides of the combustion chamber 15. The actuator holder 90 is fastened at one end to the cylinder head 14 by a bolt 91 along with the end (on the side of the intake valves VI) of the shaft holder 66 disposed in one side in a direction of arrangement of the cylinders, and at the other end to the cylinder head 14 by a bolt 92 along with the end (on the side of the exhaust valves VE) of the shaft holder 66 disposed on the other side in the direction of arrangement of the cylinders.

Thus, the actuator holder 90 is fixed on both the shaft holders 66 to form an acute angle with the direction of arrangement of the cylinders. On the other hand, a laterally and upward extending insertion tube 93 is secured at its lower end to the cylinder head 14 between both the exhaust-side rocker arms 33 in the exhaust-side valve operating device $\mathbf{31}E_2$, so that an spark plug 94 screwed into the cylinder head 14 to face a central portion of the combustion chamber 15 can be inserted into the insertion tube 93. An arcuate notch 90*a* is provided in the actuator holder 90 so as to prevent the hindrance to the operation for inserting and removing the spark plug into and from the insertion tube 93.

A cylindrical cover portion 95 is integrally provided at an upper portion of a head cover 52' fastened to the cylinder head 14, and an upper portion of the housing 53 of the actuator $\mathbf{51}_1$ with the opposite ends of the actuator holder 90 fastened to the shaft holders 66 is inserted into the cover portion 95.

Carefully referring particularly to FIG. 15, a resiliently biasing means 96 is mounted on a lower surface of the actuator holder 90 at a location above the intake-side rocker arm 74 to exhibit a biasing force for permitting the cam slipper 75 of the intake-side rocker arm 74 to be normally in contact with the second intake-side valve operating cam $\mathbf{29}I_2$. The resiliently biasing means 96 includes a cylindrical guide tube 97 which is secured at its upper end to the lower surface of the actuator holder 90 and extends vertically, a piston 98 which is slidably received in the guide tube 97, and a spring 99 which is accommodated in the guide tube 97 to exhibit a spring force for biasing the piston 98 downwards. A lower end of a rod 98*a* extending downwards from the piston 98 is in contact with the upper surface of the intake-side rocker arm 74.

Figure 17:
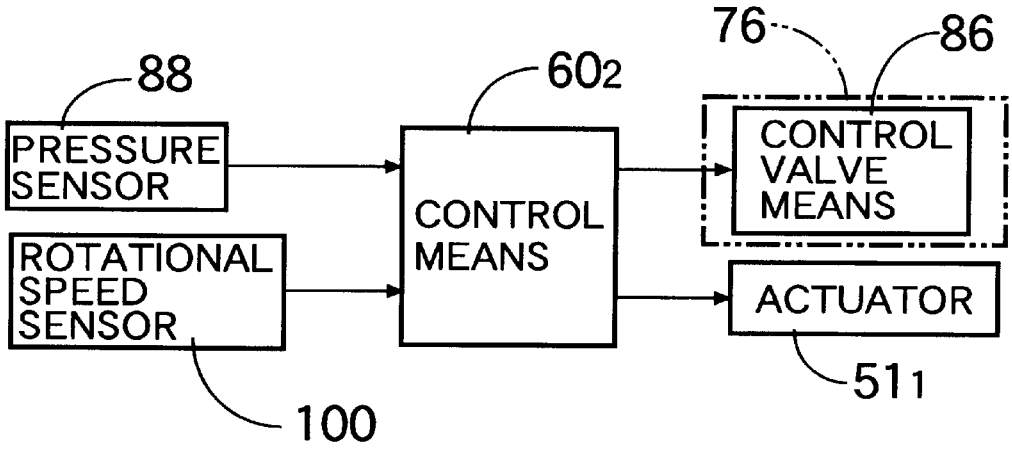

Referring to FIG. 17, a control means $\mathbf{60}_2$ controls the operations of the actuator $\mathbf{51}_1$ and the connection switch-over means 76, i.e., the operation of the control valve means 86 capable of changing the hydraulic pressure in the hydraulic pressure chamber 81 from one of the higher and lower levels to the other. Inputted to the controlmeans $\mathbf{60}_2$ are (1) a detection value provided by a rotational speed sensor 100 for detecting a rotational speed of the engine, and (2) a detection value provided by the pressure sensor 88 for detecting the completion of the connecting operation of the connection switch-over means 76. Thus the control means $\mathbf{60}_2$ controls the operation of the actuator $\mathbf{51}_1$ and the control valve means 86 based on the detecting valves of the pressure sensor 88 and the rotational speed sensor 100.

The control means $\mathbf{60}_2$ controls the actuator $\mathbf{51}_1$ and the connection switch-over means 76 in a state in which it has been switched over between a first control mode in which the connection switch-over means 76 is brought into a disconnecting state, in a lower-speed operational range of the engine, and a second control mode in which the actuator $\mathbf{51}_1$ is brought into an inoperative state and at the same time, the connection switch-over means 76 is brought into a connecting state, in a higher-speed operational range of the engine. When the mode of the control means $\mathbf{60}_2$ has been switched over from the first control mode to the second control mode, the control means $\mathbf{60}_2$ controls the actuator $\mathbf{51}_1$ and the connection switch-over means 76 according to a procedure shown in FIG. 18.

Figure 18:
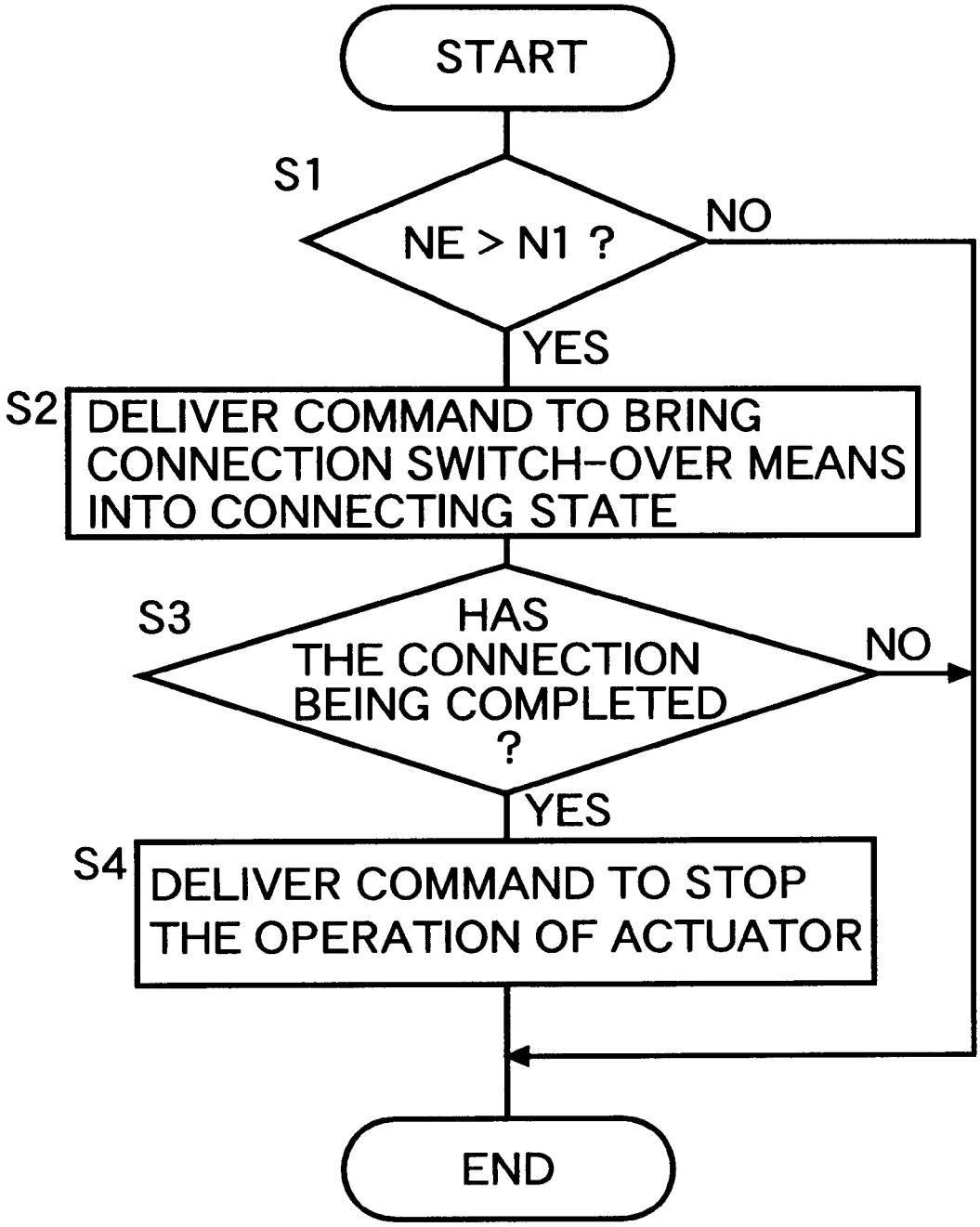

At Step S1 in FIG. 18, it is determined whether the rotational speed NE of the engine detected by the rotational speed sensor 100 exceeds a preset first rotational speed N1, e.g., 3,100 rpm. When NE>N1, the following signal is outputted at Step S2: a signal indicative of a command to provide the connecting operation of the connection switch-over means 76, i.e., a signal indicative of a command to operate the control valve means 86 to control the hydraulic pressure in the oil passage 84.

At Step S3, it is determined whether the pressure sensor 88 has detected the higher hydraulic pressure, i.e., whether the connecting operation of the connection switch-over means 76 has been substantially completed. When it is determined that the connecting operation has been completed, the operation of the actuator $\mathbf{51}_1$ is stopped at Step S4. Namely, the control means $\mathbf{60}_2$ stops the operation of the actuator $\mathbf{51}_1$ after completion of the connecting operation of the hydraulic connection switch-over means 76 whose switching-over operation is liable to be late, as compared with the operation of the electric actuator $\mathbf{51}_1$.

Figure 19:
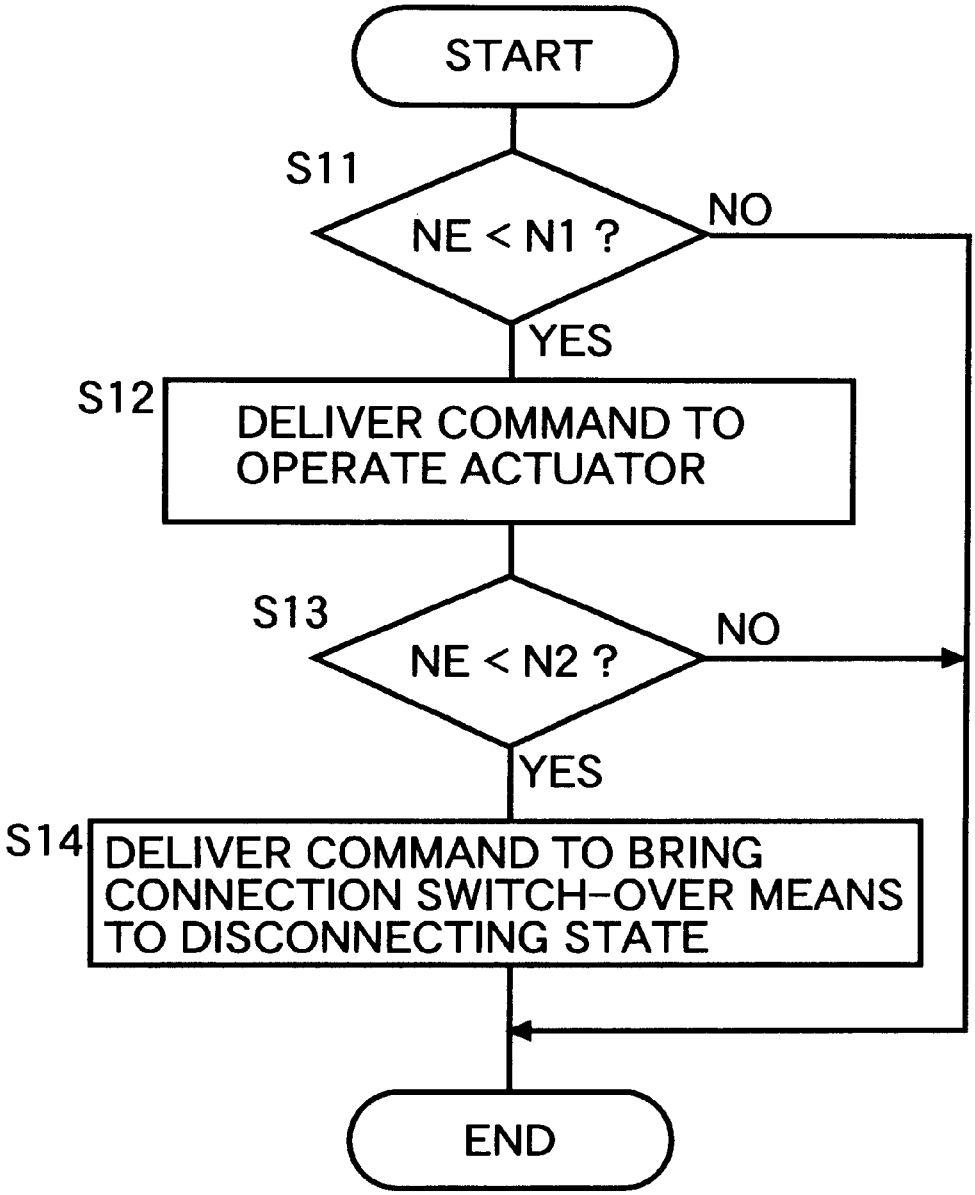

When the second control mode is changed to the first control mode, the control means $\mathbf{60}_2$ controls the actuator $\mathbf{51}_1$ and the connection switch-over means 76 according to a procedure shown in FIG. 19. At Step S11, it is determined whether the rotational speed NE of the engine detected by the rotational spewed sensor 100 is smaller than the first preset rotational speed N1. When NE<N1, the actuator $\mathbf{51}_1$ is operated at Step S12 and then, it is determined at Step S13 whether the rotational speed NE of the engine is smaller than the second preset rotational speed N2 previously determined as a value smaller than the first preset rotational speed N1, e.g., 2,900 rpm. When NE<N2, the processing is advanced to Step S14, at which a signal indicative of a command to bring the connection switch-over means 76 into the disconnecting state is outputted.

Therefore, when the second control mode is changed to the first control mode, the operation of the actuator $\mathbf{51}_1$ is first started and thereafter, the operation of connection switch-over means 76 to the disconnecting state is started.

Moreover, the second preset rotational speed N2 which is a criterion for determining the changing of the second control mode to the first control mode is set smaller than the first preset rotational speed N1 which is a criterion for determining the changing of the first control mode to the second control mode, thereby providing a hysteresis. Thus, it is possible to prevent a hunting from being produced in the control of the changing-over of the first and second control modes from one to the other.

With the third embodiment, in the intake-side valve operating device $\mathbf{31I}_2$, the connection switch-over means 76 is brought into the disconnecting state and the actuator $\mathbf{51}_1$ is operated by selecting the first control mode by the control means $\mathbf{60}_2$ in the lower-speed operating range of the engine, and the ring gear 38 in the power transmitting means 36 is driven by the actuator $\mathbf{51}_1$, whereby the operational characteristic of the intake valves VI can be finely controlled.

In the higher-speed operational range of the engine the connection switch-over means 76 is brought into the connecting state and the operation of the actuator $\mathbf{51}_1$ is stopped by selecting the second control mode by the control means $\mathbf{60}_2$. This causes the sun gear 37 to be swung along with the intake-side rocker arm 74 driven in swinging movement by the second intake-side valve operating cam $\mathbf{29I}_2$, thereby opening and closing the intake valves VI with the operational characteristic corresponding to the cam profile of the second intake-side valve operating cam $\mathbf{29I}_2$.

In this way, in the lower-speed operational range of the engine, the operational characteristic of the intake valves VI can be changed by use of the power transmitting means 36 and the actuator $\mathbf{51}_1$, and in the higher-speed operational range of the engine, the intake valves VI are driven with the operational characteristic determined by the second intake-side valve operating cam $\mathbf{29I}_2$. Thus, the responsiveness required for the actuator $\mathbf{51}_1$ may be one corresponding to the lower-speed operational range of the engine, whereby a reduction in size of the actuator $\mathbf{51}_1$ can be provided, and a reduction in amount of electric power consumed can be provided. Namely, in the higher-speed operational range of the engine in which the responsiveness of the actuator $\mathbf{51}_1$ is of a consideration, the intake valves VI are driven by the second intake-side valve operating cam $\mathbf{29I}_2$ by selecting the second control mode and in this manner, it is possible to avoid the arising of a problem due to the operation of the actuator $\mathbf{51}_1$.

Moreover, when the first control mode is changed to the second control mode, the electric actuator $\mathbf{51}_1$ is brought into the inoperative state, after it has been detected by the pressure sensor 88 that the connecting operation of the connection switch-over means 76 has been completed. Therefore, after completion of the connecting operation of the hydraulic connection switch-over means 76 whose switching operation is liable to be late as compared with the operation of the actuator $\mathbf{51}_1$, the actuator $\mathbf{51}_1$ is brought into the inoperative state. In this manner, it is possible to prevent the operation of the intake valves VI from being disturbed because the actuator $\mathbf{51}_1$ is brought into the inoperative state before starting of the driving of the intake valves VI by the second intake-side valve operating cam $\mathbf{29I}_2$. On the other hand, when the second control mode is changed to the first control mode, the connection switch-over means 76 is brought into the disconnecting state after outputting of the signal indicative of the command to bring the actuator $\mathbf{51}_1$ into the operative state. Therefore, the actuator $\mathbf{51}_1$ is brought into the operative state before the connection switch-over means 76 is brought into the disconnecting state, and in this manner, it is possible to prevent the operation of the intake valves VI from being disturbed because the connection switch-over means 76 is brought into the disconnecting state before starting of the driving of the intake valves VI by the first intake-side valve operating cam $\mathbf{29I}_1$, the power transmitting means 36 and the actuator $\mathbf{51}_1$.

In addition, since the actuator $\mathbf{51}_1$ is mounted to the shaft holders 66 which is fastened to the cylinder head 14 with the rocker arm shaft 32 and the support shaft 41 fixedly supported thereon, the rigidity of mounting of the actuator $\mathbf{51}_1$ can be enhanced, as compared with a case where the actuator is mounted to the head cover, and the position of the actuator $\mathbf{51}_1$ relative to the power transmitting means 36 cannot be offset, when the head cover 52' is mounted or removed. Thus, it is easy to mount and remove the head cover 52'.

The actuator holder 90 is fixedly mounted to extend between the shaft holders 66 disposed on the opposite sides of the combustion chamber 15, and the actuator holder 90 and the shaft holders 66 are fastened to the cylinder head 14 by the common bolts 91 and 92. Therefore, the rigidity of the shaft holders 66 can be increased, and the actuator $\mathbf{51}_1$ can be mounted to the shaft holders 66 in a compact structure with a reduced number of parts.

Further, the actuator holder 90 is fastened at one end to the cylinder head 14 by the bolt 91 along with the end (on the side of the intake valves VI) of the shaft holder 66 disposed in one side of each of the cylinders, and at the other end to the cylinder head 14 by the bolt 92 along with the end (on the sides of the exhaust valves VE) of the shaft holder 66 disposed on the other side of each of the cylinder. Therefore, the actuator holder 90 is mounted to the shaft holders 66 by the minimum number of, i.e., two bolts 91 and 92, and the actuator $\mathbf{51}_1$ can be mounted to the shaft holders 66 in a compact structure in which the mounting and removing operation is easy.

Figure 20:
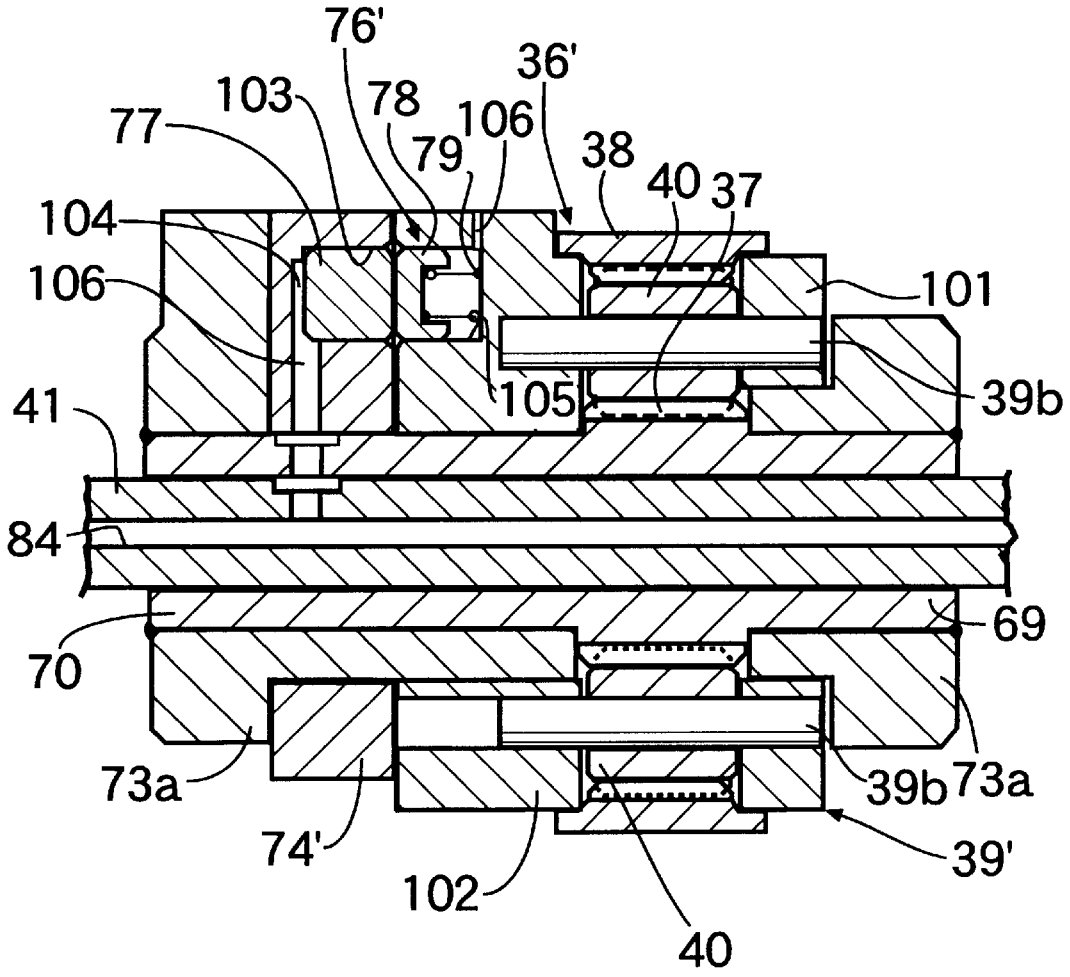
FIG. 20 is a sectional view similar to FIG. 14, but according to a fourth embodiment of the present invention.

FIG. 20 shows a fourth embodiment of the present invention, wherein portions or components corresponding to those in the first embodiment are designated by like reference characters.

Intake valves VI (see the third embodiment) are connected to a sun gear 37 of a power transmitting means 36', and an actuator $\mathbf{51}_1$ (see the third embodiment) is operatively connected to a ring gear 38. A first intake-side valve operating cam $\mathbf{29I}_1$ (see the third embodiment) is operatively connected to a carrier 39'.

The carrier 39' includes a pair of ring-shaped support plates 101 and 102, and a plurality of shafts **39*b* supported at opposite ends on the support plates. Planetary gears 40 are rotatably carried on the shafts 39*b***.

Moreover, a connection switch-over means 76' is provided between an intake-side rocker arm 74' moved following a second intake-side valve operating cam $\mathbf{29I}_2$ (see the third embodiment) and a support plate 102 for the carrier 39'.

The connection switch-over means 76' includes a connecting piston 77 which is slidably received in the intake-side rocker arm 74', so that it can be fitted into the support plate 102, a bottomed cylindrical interlocking member 78 which is slidably received in the support plate 102 for movement along with the connecting piston 77, and a return spring 79 mounted between the interlocking member 78 and the support plate 102 to exhibit a spring force for biasing the interlocking member 78 toward the connecting piston 77.

A first bottomed slide bore 103 is provided in the intake-side rocker arm 74' with its axis parallel to the axis of the support shaft 41, and opens toward the support plate 102. The connecting piston 77 is slidably received in the first slide bore 103 to define a hydraulic pressure chamber 104 between the connecting piston 77 and a closed end of the first slide bore 103.

The support plate 102 is also provided with a second bottomed slide bore 105 having the same diameter as the first slide bore 103, and an open bore 106 leading to a closed end of the second slide bore 105. The interlocking member 78 with its closed end in sliding contact with the connecting piston 77 is slidably received in the second slide bore 105. Further, the return spring 79 is mounted under compression between the closed end of the second slide bore 105 and the interlocking member 78.

A communication passage 106 is provided in the intake-side rocker arm 74', a cylindrical portion 70 of the sun gear 37 and the support shaft 41 to permit the oil passage 84 in the support shaft 41 to communicate with the hydraulic pressure chamber 104 despite the turning movement of the intake-side rocker arm 74'.

Even in the fourth embodiment, in a lower-speed operational range of the engine, the connection switch-over means 76' is brought into its disconnecting state, and in a higher-speed operational range of the engine, the connection switch-over means 76' is brought into its connecting state.

When the connection switch-over means 76' is in the connecting state, the carrier 39' is swung along with the intake-side rocker arm 74' driven in swinging movement by the second intake-side valve operating cam $\mathbf{29I_2}$. In this case, the ring gear 38 is driven in turning movement by the actuator $\mathbf{51_1}$ which is in the inoperative state(see the third embodiment). Therefore, the sun gear 37 is turned by the carrier 39' swung along with the intake-side rocker arm 74', and the intake valves VI are opened and closed with an operational characteristic corresponding to the cam profile of the second intake-side valve operating cam $\mathbf{29I_2}$.

In an alternative embodiment of the present invention, the second control mode in which the actuator $\mathbf{51_1}$ or $\mathbf{51_2}$ is brought into the inoperative state and the connection switch-over means 76 or 76' is brought into the connecting state, may be selected in the lower-speed operational range of the engine. The second control mode in which the actuator $\mathbf{51_1}$ or $\mathbf{51_2}$ is operated and the connection switch-over means 76 or 76' is brought into the disconnecting state, may be selected in the higher-speed operational range of the engine. If the control mode is selected in the above manner, it is possible to avoid that the electric power of a battery is consumed by the actuator $\mathbf{51_1}$ or $\mathbf{51_2}$ in the lower-speed operational range of the engine in which the charged amount of the battery is reduced, and it is possible to prevent an adverse influence from being exerted to the battery due to the operation of the actuator $\mathbf{51_1}$ or $\mathbf{51_2}$.

In the above-described embodiments, it has been determined based on the detection value provided by the pressure sensor 88 for detecting the hydraulic pressure that the connecting operation of the hydraulic connection switch-over means 76 or 76' has been completed. However, the completion of the connecting operation of the connection switch-over means 76 or 76' may be determined based on the lapse of a preset time after outputting of the signal indicative of the command to provide the connecting operation of the connection switch-over means 76 or 76'. Alternatively, the completion of the connecting operation of the connection switch-over means 76 or 76' may be determined by directly detecting the operation of the connecting piston 77 or the interlocking member 78 in the connection switch-over means 76 or 76'.

In a further alternate embodiment of the present invention, a planetary friction-type power transmitting means (a traction drive) as disclosed in Japanese Patent Application Nos. 5-33840, 5-79450, 5-157149, 6-34005 and 6-66360 may be used as a power transmitting means. The present invention is applicable to an exhaust valve as an engine valve.

Although the embodiments of the present invention have been described in detail, it will be understood that the present invention is not limited to the above-described embodiments, and various modifications in design may be made without departing from the spirit and scope of the invention defined in claims.

What is claimed is:

1. A valve operating system in an internal combustion engine, comprising an electric actuator which enables a force to be applied in a valve-opening direction to an engine valve that is biased in a valve-closing direction by a spring, wherein said actuator is connected to one of components of a force transmitting means capable of transmitting a force provided by a valve operating cam provided on a cam shaft to the engine valve, so that said engine valve can receive the force from said electric actuator in said valve-opening direction independently of the force provided by said valve operating cam in said valve opening direction, and can be be driven in a lift amount obtained by addition of a lift amount of said engine valve based on a cam profile of said valve operating cam and a lift amount of said engine valve based on the operation of said actuator wherein said components of said force transmitting means are: an inner ring which is turnable about an axis parallel to said cam shaft; am outer ring which is turnable about the same axis as of said inner ring and surrounds said inner ring; and a carrier on which planetary rotors disposed between said inner and outer rings are carried for rotation about axes parallel to the axis of said inner and outer rings, said carrier being turned in operative association with a revolving movement of said planetary rotors around said inner ring, a first one of said components being connected to said engine valve, a second one of said components being operatively connected to said valve operating cam, and said actuator being connected to a third one of said components.

2. A valve operating system in an internal combustion engine according to claim 1, wherein said inner ring is connected to said engine valve; one of said carrier and said outer ring is operatively connected to said valve operating cam on said cam shaft for turning movement in response to the rotation of said cam shaft, and said actuator is connected to the other of said carrier and said outer ring.

3. A valve operating system in an internal combustion engine according to claim 2, wherein said carrier is operatively connected to said valve operating cam, and said actuator is connected to said outer ring.

4. A valve operating system in an internal combustion engine according to claim 3, wherein said carrier is integrally provided with a roller retaining arm extending on the side of said valve operating cam, with a roller being pivoted at a tip end of said roller retaining arm to come into rolling contact with said valve operating cam.

5. A valve operating system in an internal combustion engine according to claim 4, wherein said carrier comprises a pair of support plates disposed on opposite side of said planetary rotors, and shafts which are provided to extend between said support plates and on which said planetary rotors are rotatably carried, and said roller is formed longer than an entire axial length of the planetary rotor and is supported rotatably by a roller shaft, said roller shaft being fixed at opposite ends thereof to a pair of said roller retaining arms integrally provided on said support plates, with steps for supporting said outer ring being formed between inner surfaces of said roller retaining arms and inner surfaces of said support plates.

6. A valve operating system in an internal combustion engine according to claim 1, wherein said power transmitting means is formed into a planetary gear type having a sun gear which is said inner ring, a ring gear which is said outer ring, and said carrier on which planetary gears as said planetary rotors are rotatably carried.

7. A valve operating system in an internal combustion engine according to claim 1, further including a support shaft for supporting said inner ring for turning movement, said support shaft having an axis disposed in parallel to but offset from the axis of said cam shaft.

8. A valve operating system in an internal combustion engine according to claim 2, wherein said second one of the components of said power transmitting means is operatively connected to a first valve operating cam provided on said cam shaft, and said valve operating system further includes a connection switch-over means which is provided between one of said first and second components and a rocker arm rotatable about the same axis as of said inner ring in a manner to follow a second valve operating cam provided on said cam shaft, said connection switch-over means being capable of being switched over between a connecting state in which said one of said first and second components is connected to said rocker arm, and a disconnecting state in which the connection between said one of said first and second components and said rocker arm is released, and a control means for controlling the operations of said actuator and said connection switch-over means, said control means being arranged to change over a control mode thereof, depending on the operational state of the engine, between a first control mode in which said actuator is in an operative state and said connection switch-over means is brought into said disconnecting state, and a second control mode in which said actuator is brought into an inoperative state and said connection switch-over means is brought into said connecting state.

9. A valve operating system in an internal combustion engine according to claim 8, wherein said connection switch-over means is arranged so that the connecting state and the disconnecting state are switched over from one to the other in accordance with a hydraulic pressure, and said control means is formed to output a signal indicative of a command to bring said electric actuator into said inoperative state after completion of the connecting operation of said connection switch-over means, when the control mode is switched over from the first control mode to the second control mode, and to output a signal indicative of a command to bring said connection switch-over means into said disconnecting state after outputting of a signal indicative of a command to bring said actuator into said operative state, when the control mode is switched over from the second control mode to the first control mode.

10. A valve operating system in an internal combustion engine according to claim 9, wherein said control means is arranged to select the second control mode in a low-speed operational range of the engine and to select the first control mode in a high-speed operational range of the engine.

11. A valve operating system in an internal combustion engine according to claim 8, wherein said control means is arranged to select the second control mode in a low-speed operational range of the engine and to select the first control mode in a high-speed operational range of the engine.

12. A valve operating system in an internal combustion engine, comprising an electric actuator which enables a force to be applied in a valve-opening direction to an engine valve that is biased in a valve-closing direction by a spring, wherein said actuator is connected to one of components of a force transmitting means capable of transmitting a force provided by a valve operating cam provided on a cam shaft to the engine valve, so that said engine valve can receive the force from said electric actuator in said valve-opening direction independently of the force provided by said valve operating cam in said valve opening direction, and can be be driven in a lift amount obtained by addition of a lift amount of said engine valve based on a cam profile of said valve operating cam and a lift amount of said engine valve based on the operation of said actuator wherein said valve operating cam has a cam profile which provides a lift characteristic describing a buffer curve immediately before closing and seating of said engine valve, and said system further includes a control means of controlling said actuator, said control means being arranged to stop the delivery of a driving force from said actuator to said force transmitting means at least at a moment immediately before closing and seating of said engine valve within a period while said engine valve is open.

* * * * *